US006782892B2

(12) United States Patent
Li et al.

(10) Patent No.: US 6,782,892 B2
(45) Date of Patent: Aug. 31, 2004

(54) MANGANESE OXIDE MIXTURES IN NANOPARTICLE FORM TO LOWER THE AMOUNT OF CARBON MONOXIDE AND/OR NITRIC OXIDE IN THE MAINSTREAM SMOKE OF A CIGARETTE

(75) Inventors: Ping Li, Chesterfield, VA (US); Firooz Rasouli, Midlothian, VA (US); Mohammad Hajaligol, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 0 days.

(21) Appl. No.: 10/231,134

(22) Filed: Aug. 30, 2002

(65) Prior Publication Data

US 2004/0040566 A1 Mar. 4, 2004

(51) Int. Cl.[7] ..... A24D 1/00
(52) U.S. Cl. ..... 131/364; 131/360; 131/31
(58) Field of Search ..... 131/364, 360, 131/352, 347, 31

(56) References Cited

U.S. PATENT DOCUMENTS

| | | | | |
|---|---|---|---|---|
| 3,407,820 | A | | 10/1968 | Westcott et al. |
| 3,720,214 | A | | 3/1973 | Norman et al. |
| 3,807,416 | A | | 4/1974 | Hedge et al. |
| 3,931,824 | A | | 1/1976 | Miano et al. |
| 4,109,663 | A | | 8/1978 | Maeda et al. |
| 4,119,104 | A | | 10/1978 | Roth |
| 4,125,118 | A | | 11/1978 | Rudner |
| 4,193,412 | A | | 3/1980 | Heim et al. |
| 4,195,645 | A | | 4/1980 | Bradley et al. |
| 4,197,861 | A | | 4/1980 | Keith |
| 4,317,460 | A | | 3/1982 | Dale et al. |
| 4,397,321 | A | * | 8/1983 | Stuetz ..... 131/334 |
| RE31,700 | E | | 10/1984 | Yamaguchi |
| 4,956,330 | A | | 9/1990 | Elliott et al. |
| 5,050,621 | A | | 9/1991 | Creighton et al. |
| 5,101,839 | A | | 4/1992 | Jakob et al. |
| 5,105,836 | A | | 4/1992 | Gentry et al. |
| 5,129,408 | A | | 7/1992 | Jakob et al. |
| 5,258,340 | A | | 11/1993 | Augustine et al. |
| 5,322,075 | A | | 6/1994 | Deevi et al. |
| 5,525,330 | A | | 6/1996 | Gaffar et al. |
| 5,591,368 | A | | 1/1997 | Fleischhauer et al. |
| 5,598,868 | A | | 2/1997 | Jakob et al. |
| 5,934,289 | A | | 8/1999 | Watkins et al. |
| 6,053,176 | A | | 4/2000 | Adams et al. |
| 6,095,152 | A | | 8/2000 | Beven et al. |

FOREIGN PATENT DOCUMENTS

| | | |
|---|---|---|
| CH | 609217 | 2/1979 |
| CN | 1312038 | 9/2001 |
| GB | 685822 | 1/1953 |
| GB | 863287 | 3/1961 |
| GB | 973854 | 10/1964 |
| GB | 1104993 | 3/1968 |
| GB | 1315374 | 5/1973 |
| WO | WO87/06104 | 10/1987 |
| WO | WO00/40104 | 7/2000 |

OTHER PUBLICATIONS

James E. Brady, et al "Fundamentals of Chemistry, 2nd Edition", John Wiley & Sons, pp. 409–411.*

Kyung I. Choi et al., CO Oxidation Over Pd and Cu Catalysts, Journal of Catalysis ppgs. 131, 1–21 (1991), Academic Press, Inc.

Kenneth M. Bryden et al., Numerical Modeling of a Deep, Fixed Bed Combustor, Energy & Fuels 1996, 10, ppgs 269–275, Advance ACS Abstracts, Feb. 15, 1996, American Chemical Society.

N.W. Cant et al., Cobalt Promotion of Au/$TIO_2$ Catalysts for the Reaction of Carbon Monoxide with Oxygen and Nitrogen Oxides, Catalysis Today 36 (1997), ppgs 125–133, Elsevier Science B.V.

J.S. Walker et al., Carbon Monoxide and Propene Oxidation by Iron Oxides for Auto–Emission Control, Journal of Catalysis 110, 1988 ppgs 298–309, Academic Press, Inc.

* cited by examiner

*Primary Examiner*—Dionne A. Walls
(74) *Attorney, Agent, or Firm*—Burns, Doane, Swecker & Mathis, L.L.P.

(57) ABSTRACT

Cut filler compositions, cigarettes, methods for making cigarettes and methods for smoking cigarettes which involve the use of manganese oxide mixtures that include nanoparticle manganese oxide and other nanoparticle additive(s) capable of converting carbon monoxide to carbon dioxide and/or converting nitric oxide to nitrogen. The compositions, articles and methods of the invention can be used to reduce the amount of carbon monoxide and/or nitric oxide present in mainstream smoke reaching the smoker and/or given off in secondhand smoke. The manganese oxide can be co-precipitated with the additive(s), or mechanically mixed with the additive(s) to form the manganese oxide mixture. The manganese oxide may have a lower light-off temperature than the additive, such that during smoking of the cigarette, the heat generated from the oxidation of carbon monoxide by manganese oxide is capable of activating the additive. The additive may include iron oxide ($Fe_2O_3$) nanoparticles.

53 Claims, 26 Drawing Sheets

SCHEMATICS OF QUARTZ FLOW TUBE REACTOR

MANGANESE OXIDE MIXTURES IN NANOPARTICLE FORM TO LOWER THE AMOUNT OF CARBON MONOXIDE AND/OR NITRIC OXIDE IN THE MAINSTREAM SMOKE OF A CIGARETTE

FIELD OF INVENTION

The invention relates generally to lowering the amount of carbon monoxide and/or nitric oxide in the mainstream smoke of a cigarette during smoking. More specifically, the invention relates to cut filler compositions, cigarettes, methods for making cigarettes and methods for smoking cigarettes, which involve the use of manganese oxide mixtures. These mixtures include manganese oxide with other additive(s) capable of converting carbon monoxide to carbon dioxide and/or converting nitric oxide to nitrogen in nanoparticle form.

BACKGROUND

Various methods for reducing the amount of carbon monoxide and/or nitric oxide in the mainstream smoke of a cigarette during smoking have been proposed. For example, British Patent No. 863,287 describes methods for treating tobacco prior to the manufacture of tobacco articles, such that incomplete combustion products are removed or modified during smoking of the tobacco article. This is said to be accomplished by adding a calcium oxide or a calcium oxide precursor to the tobacco. Iron oxide is also mentioned as an additive to the tobacco.

Cigarettes comprising absorbents, generally in a filter tip, have been suggested for physically absorbing some of the carbon monoxide, but such methods are usually not completely efficient. A cigarette filter for removing byproducts formed during smoking is described in U.S. Reissue Pat. No. RE 31,700, where the cigarette filter comprises dry and active green algae, optionally with an inorganic porous adsorbent such as iron oxide. Other filtering materials and filters for removing gaseous byproducts, such as hydrogen cyanide and hydrogen sulfide, are described in British Patent No. 973,854. These filtering materials and filters contain absorbent granules of a gas-adsorbent material, impregnated with finely divided oxides of both iron and zinc. In another example, an additive for smoking tobacco products and their filter elements, which comprises an intimate mixture of at least two highly dispersed metal oxides or metal oxyhydrates, is described in U.S. Pat. No. 4,193,412. Such an additive is said to have a synergistically increased absorption capacity for certain substances in the tobacco smoke. British Patent No. 685,822 describes a filtering agent that is said to oxidize carbon monoxide in tobacco smoke to carbonic acid gas. This filtering agent contains, for example, manganese dioxide and cupric oxide, and slaked lime. The addition of ferric oxide in small amounts is said to improve the efficiency of the product.

The addition of an oxidizing reagent or catalyst to the filter has been described as a strategy for reducing the concentration of carbon monoxide reaching the smoker. The disadvantages of such an approach, using a conventional catalyst, include the large quantities of oxidant that often need to be incorporated into the filter to achieve considerable reduction of carbon monoxide. Moreover, if the ineffectiveness of the heterogeneous reaction is taken into account, the amount of the oxidant required would be even larger. For example, U.S. Pat. No. 4,317,460 describes supported catalysts for use in smoking product filters for the low temperature oxidation of carbon monoxide to carbon dioxide. Such catalysts include mixtures of tin or tin compounds, for example, with other catalytic materials, on a microporous support. Another filter for smoking articles is described in Swiss patent 609,217, where the filter contains tetrapyrrole pigment containing a complexed iron (e.g. haemoglobin or chlorocruorin), and optionally a metal or a metal salt or oxide capable of fixing carbon monoxide or converting it to carbon dioxide. In another example, British Patent No. 1,104,993 relates to a tobacco smoke filter made from sorbent granules and thermoplastic resin. While activated carbon is the preferred material for the sorbent granules, it is said that metal oxides, such as iron oxide, may be used instead of, or in addition to the activated carbon. However, such catalysts suffer drawbacks because under normal conditions for smoking, catalysts are rapidly deactivated, for example, by various byproducts formed during smoking and/or by the heat. In addition, as a result of such localized catalytic activity, such filters often heat up during smoking to unacceptable temperatures.

Catalysts for the conversion of carbon monoxide to carbon dioxide are described, for example, in U.S. Pat. Nos. 4,956,330 and 5,258,330. A catalyst composition for the oxidation reaction of carbon monoxide and oxygen to carbon dioxide is described, for example, in U.S. Pat. No. 4,956,330. In addition, U.S. Pat. No. 5,050,621 describes a smoking article having a catalytic unit containing material for the oxidation of carbon monoxide to carbon dioxide. The catalyst material may be copper oxide and/or manganese dioxide. The method of making the catalyst is described in British Patent No. 1,315,374. Finally, U.S. Pat. No. 5,258,340 describes a mixed transition metal oxide catalyst for the oxidation of carbon monoxide to carbon dioxide. This catalyst is said to be useful for incorporation into smoking articles.

Transition metals have been described for use in cigarette filters or smoking articles. U.S. Pat. No. 3,407,820 describes a tobacco smoke filter containing manganese (IV) oxide dihydroxide for the purpose of removing nitrogen oxides from smoke. British Patent No. 685822 describes filtering agents, where carbon monoxide in tobacco smoke is converted to carbon dioxide, by passing it over metal oxides, including manganese dioxide and cupric oxide, kept dry by admixture with, e.g. three times the quantity of, slaked lime. U.S. Pat. No. 4,125,118 states that the amounts of tars, nicotine, phenols, carbon monoxide, hydrogen cyanide, etc. generated during the smoking of tobacco and its substitutes is reduced by incorporating in the smoking composition a small amount of a transition metal compound.

Metal oxides, such as iron oxide have also been suggested for use in cigarettes for various purposes. For example, in WO 87/06104, the addition of small quantities of zinc oxide or ferric oxide to tobacco is described, for the purposes of reducing or eliminating the production of certain byproducts, such as nitrogen-carbon compounds, as well as removing the stale "after taste" associated with cigarettes. The iron oxide is provided in particulate form, such that under combustion conditions, the ferric oxide or zinc oxide present in minute quantities in particulate form is reduced to iron. The iron is claimed to dissociate water vapor into hydrogen and oxygen, and cause the preferential combustion of nitrogen with hydrogen, rather than with oxygen and carbon, thereby preferentially forming ammonia rather than the nitrogen-carbon compounds.

In another example, U.S. Pat. No. 3,807,416 describes a smoking material comprising reconstituted tobacco and zinc oxide powder. Further, U.S. Pat. No. 3,720,214 relates to a smoking article composition comprising tobacco and a catalytic agent consisting essentially of finely divided zinc oxide. This composition is described as causing a decrease in the amount of polycyclic aromatic compounds during smoking. Another approach to reducing the concentration of carbon monoxide is described in WO 00/40104, which describes combining tobacco with loess and optionally iron oxide compounds as additives. The oxide compounds of the constituents in loess, as well as the iron oxide additives are said to reduce the concentration of carbon monoxide.

Moreover, iron oxide has also been proposed for incorporation into tobacco articles, for a variety of other purposes. For example, iron oxide has been described as particulate inorganic filler (e.g. U.S. Pat. Nos. 4,197,861; 4,195,645; and 3,931,824), as a coloring agent (e.g. U.S. Pat. No. 4,119,104) and in powder form as a burn regulator (e.g. U.S. Pat. No. 4,109,663). In addition, several patents describe treating filler materials with powdered iron oxide to improve taste, color and/or appearance (e.g. U.S. Pat. Nos. 6,095,152; 5,598,868; 5,129,408; 5,105,836 and 5,101,839). Chinese Patent No. 1312038 describes a cigarette comprising iron and iron oxide (including FeO, $Fe_2O_3$, $Fe_3O_4$, and ferrite) as additives for reducing stimulant and abnormal smell of smoke and reducing certain components of smoke. However, the prior attempts to make cigarettes incorporating metal oxides, have not led to the effective reduction of carbon monoxide in mainstream smoke.

Despite the developments to date, there remains a continued interest in improved and more efficient methods and compositions for lowering the amount of carbon monoxide and/or nitric oxide in the mainstream smoke of a cigarette during smoking. Preferably, such methods and compositions should not involve expensive or time consuming manufacturing and/or processing steps. More preferably, it should be possible to convert carbon monoxide to carbon dioxide and/or convert nitric oxide to nitrogen not only in the filter region of the cigarette, but also along the length of the cigarette during smoking.

SUMMARY

The invention relates to cut filler compositions, cigarettes, methods for making cigarettes and methods for smoking cigarettes which involve the use of manganese oxide mixtures, which include manganese oxide with other additive(s) capable of converting carbon monoxide to carbon dioxide and/or converting nitric oxide to nitrogen in nanoparticle form.

In an embodiment of the invention, cut filler compositions are provided, which comprise tobacco, manganese oxide, and at least one additive capable of converting carbon monoxide to carbon dioxide and/or converting nitric oxide to nitrogen, wherein the manganese oxide and the additive are both in the form of nanoparticles.

In another embodiment of the invention, cigarettes are provided, which comprise a tobacco rod that comprises cut filler having manganese oxide and at least one additive capable of converting carbon monoxide to carbon dioxide and/or converting nitric oxide to nitrogen. The manganese oxide and the additive are both in the form of nanoparticles. In one embodiment, a cigarette according to the invention contains manganese oxide and the additive in a total amount from about 5 mg per cigarette to about 100 mg per cigarette, or in a total amount from about 40 mg per cigarette to about 50 mg per cigarette In another embodiment of the invention, methods for making cigarettes are provided, which comprise:

(i) adding manganese oxide and at least one additive capable of converting carbon monoxide to carbon dioxide and/or converting nitric oxide to nitrogen to a cut filler, wherein the manganese oxide and the additive are both in the form of nanoparticles;

(ii) providing the cut filler comprising the manganese oxide and additive to a cigarette making machine to form a tobacco rod; and (iii) placing a paper wrapper around the tobacco rod to form the cigarette.

In an embodiment of the invention, the manganese oxide can be co-precipitated with the additive prior to (i) above, or mechanically mixed with the additive prior to (i) above.

In yet another embodiment of the invention, methods for smoking the cigarettes according to the invention are provided, which involves lighting the cigarette to form smoke and drawing the smoke through the cigarette, wherein during the smoking of the cigarette, the manganese oxide and/or the additive convert carbon monoxide to carbon dioxide and/or convert nitric oxide to nitrogen.

Preferably, the additive used with the manganese oxide is capable of converting carbon monoxide to carbon dioxide and converting nitric oxide to nitrogen. The additive may be selected from the group consisting of metal oxides, doped metal oxides, and mixtures thereof. For instance, the additive may be selected from the group consisting of $Fe_2O_3$, CuO, $TiO_2$, $CeO_2$, $Ce_2O_3$, $Al_2O_3$, $Y_2O_3$ doped with zirconium, $Mn_2O_3$ doped with palladium, and mixtures thereof. Preferably, the additive comprises $Fe_2O_3$.

Preferably, the manganese oxide has a lower light-off temperature than the additive, such that during smoking of the cigarette, the heat generated from the oxidation of carbon monoxide by manganese oxide activates the additive.

The manganese oxide may be combined with the additive in any suitable manner. For example, the manganese oxide may be co-precipitated with the additive, or it may be mechanically mixed with the additive.

In an embodiment of the invention, the manganese oxide and the additive both have an average particle size less than about 500 nm, more preferably less than about 100 nm, even more preferably less than about 50 nm, and most preferably less than about 5 nm. Preferably, the manganese oxide and the additive both have a surface area from about 20 $m^2/g$ to about 400 $m^2/g$, or more preferably from about 200 $m^2/g$ to about 300 $m^2/g$.

The manganese oxide and the additive are typically used in an amount effective to convert at least 50%, or more preferably at least 80% of the carbon monoxide to carbon dioxide and/or at least 50%, or more preferably at least 80% of the nitric oxide to nitrogen.

BRIEF DESCRIPTION OF THE DRAWINGS

Various features and advantages of this invention will be apparent upon consideration of the following detailed description, taken in conjunction with the accompanying drawings, in which.

DETAILED DESCRIPTION OF THE INVENTION

Figure 1:
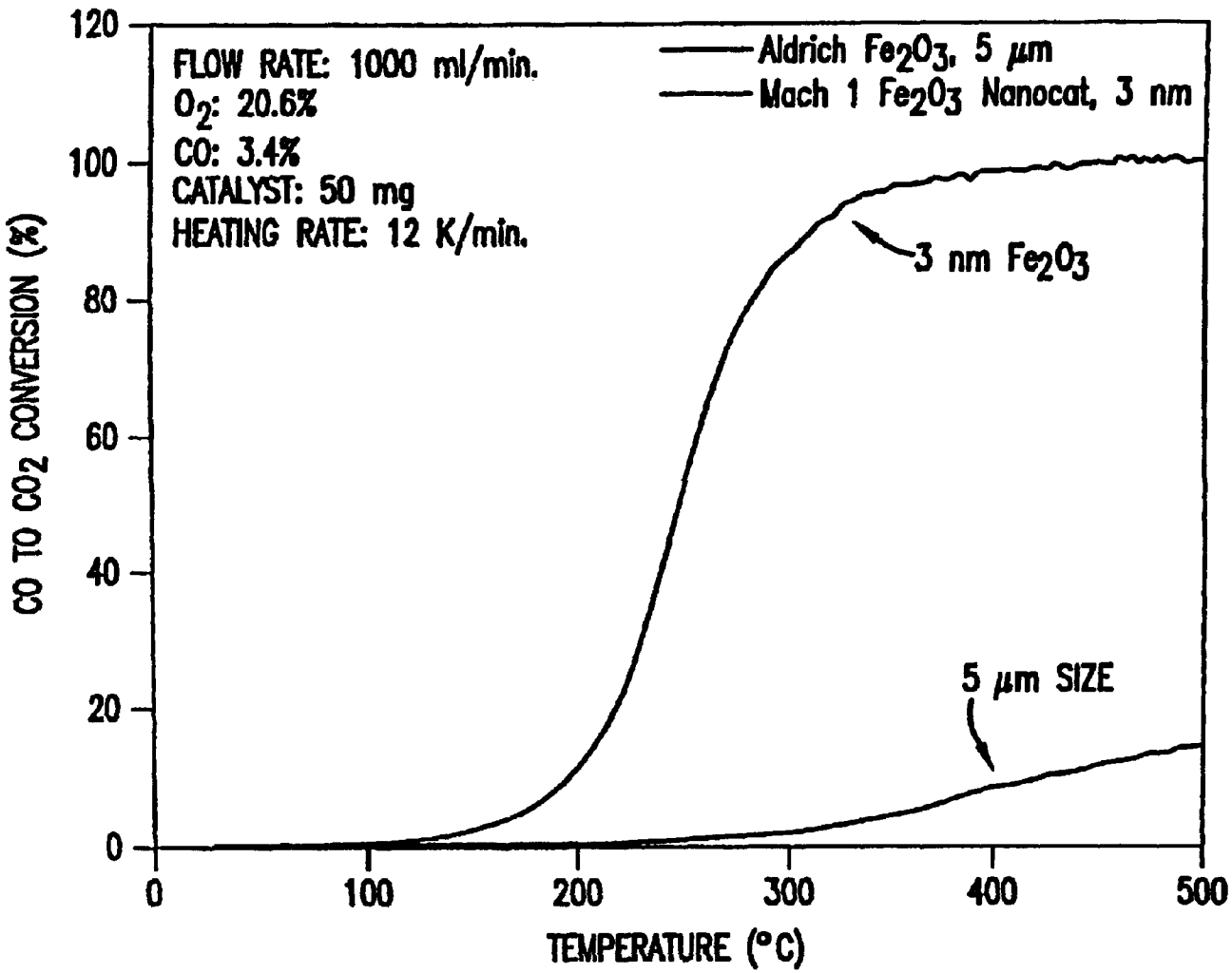
FIG. 1 depicts a comparison between the catalytic activity of $Fe_2O_3$ nanoparticles (NANOCAT® Superfine Iron Oxide (SFIO) from MACH I, Inc., King of Prussia, Pa.) having an average particle size of about 3 nm, versus $Fe_2O_3$ powder (from Aldrich Chemical Company) having an average particle size of about 5 $\mu$m.

Through the invention, the amount of carbon monoxide and/or nitric oxide in mainstream smoke can be lowered, thereby also reducing the amount of carbon monoxide and/or nitric oxide reaching the smoker or given off as second-hand smoke. In particular, the invention provides cut filler compositions, cigarettes, methods for making cigarettes and methods for smoking cigarettes, which involve the use of manganese oxide mixtures. The manganese oxide nanoparticle mixture includes manganese oxide with other additive(s) capable of converting carbon monoxide to carbon dioxide and/or converting nitric oxide to nitrogen. Both the manganese oxide and the additive are in nanoparticle form.

Preferably, the manganese oxide and additive mixture catalyzes the following reaction during smoking, such that the amount of carbon monoxide and/or nitric oxide in mainstream smoke is lowered:

$$2CO+2NO \approx 2CO_2+N_2$$

The term "mainstream" smoke refers to the mixture of gases passing down the tobacco rod and issuing through the filter end, i.e. the amount of smoke issuing or drawn from the mouth end of a smoking article during smoking.

The total amount of carbon monoxide formed during smoking comes from a combination of three main sources: thermal decomposition (about 30%), combustion (about 36%) and reduction of carbon dioxide with carbonized tobacco (at least 23%). Formation of carbon monoxide from thermal decomposition starts at a temperature of about 180° C., and finishes at around 1050° C., and is largely controlled by chemical kinetics. Formation of carbon monoxide and carbon dioxide during combustion is controlled largely by the diffusion of oxygen to the surface ($k_a$) and the surface reaction ($k_b$). At 250° C., $k_a$ and $k_b$, are about the same. At 400° C., the reaction becomes diffusion controlled. Finally, the reduction of carbon dioxide with carbonized tobacco or charcoal occurs at temperatures around 390° C. and above.

Nitric oxide, though produced in lesser quantities than the carbon monoxide, also is generated by similar thermal decomposition, combustion and reduction reactions from various nitrogen-containing compounds.

Besides the tobacco constituents, the temperature and the oxygen concentration are the two most significant factors affecting the formation and reaction of carbon monoxide and carbon dioxide. While not wishing to be bound by theory, it is believed that the nanoparticle manganese oxide and the nanoparticle additive in the mixture can target the various reactions that occur in different regions of the cigarette during smoking. Thus, the nanoparticle manganese oxide and the nanoparticle additive can be used to remove or lower the amount of carbon monoxide and/or nitric oxide not only in the filter region, but also along the cigarette during smoking.

During smoking there are three distinct regions in a cigarette: the combustion zone, the pyrolysis/distillation zone, and the condensation/filtration zone. First, the "combustion region" is the burning zone of the smoking article produced during smoking. The temperature in the combustion zone ranges from about 700° C. to about 950° C., and the heating rate can go as high as 500° C./second. The concentration of oxygen is low in this region, since it is being consumed in the combustion of tobacco to produce carbon monoxide, carbon dioxide, water vapor, and various organics. This reaction is highly exothermic and the heat generated here is carried by gas to the pyrolysis/distillation zone. The low oxygen concentrations coupled with the high temperature leads to the reduction of carbon dioxide to carbon monoxide by the carbonized tobacco. In this region, the manganese oxide nanoparticle mixture may act as an oxidant to convert carbon monoxide to carbon dioxide. As an oxidant, the manganese oxide nanoparticle mixture oxidizes carbon monoxide in the absence of oxygen. The oxidation reaction begins at around 150° C., and reaches maximum activity at temperatures higher than about 460° C.

The "pyrolysis region" is the region behind the combustion region, where the temperatures range from about 200° C. to about 600° C. This is where most of the carbon monoxide is produced. The major reaction in this region is the pyrolysis (i.e. the thermal degradation) of the tobacco that produces carbon monoxide, carbon dioxide, smoke components, and charcoal using the heat generated in the combustion zone. There is some oxygen present in this zone, and thus the manganese oxide nanoparticle mixture may act as a catalyst for the oxidation of carbon monoxide to carbon dioxide. As a catalyst, the manganese oxide nanoparticle mixture catalyzes the oxidation of carbon monoxide by oxygen to produce carbon dioxide. The catalytic reaction begins at 150° C. and reaches maximum activity around 300° C. The manganese oxide nanoparticle mixture preferably retains its oxidant capability after it has been used as a catalyst, so that it can also function as an oxidant in the combustion region as well.

Third, there is the condensation/filtration zone, where the temperature ranges from ambient to about 150° C. and the major process is the condensation/filtration of the smoke components. Some amount of carbon monoxide, carbon dioxide, nitric oxide and/or nitrogen diffuse out of the cigarette and some oxygen diffuses into the cigarette. However, in general, the oxygen level does not recover to the atmospheric level.

As mentioned above, the manganese oxide nanoparticle mixture comprises manganese oxide and at least one additive capable of converting carbon monoxide to carbon dioxide and/or converting nitric oxide to nitrogen. By "converting" carbon monoxide or nitric oxide is meant that the manganese oxide nanoparticle mixture chemically reacts with and/or catalyzes the reaction of carbon monoxide or nitric oxide during smoking of the cigarette. For example, the manganese oxide nanoparticle mixture may function as a catalyst for the conversion of carbon monoxide to carbon dioxide and/or a catalyst for the conversion of nitric oxide to nitrogen. In a preferred embodiment of the invention, the manganese oxide nanoparticle mixture is capable of acting as both a catalyst for the conversion of carbon monoxide to carbon dioxide and a catalyst for the conversion of nitric oxide to nitrogen. The manganese oxide nanoparticle mixture may also function as an oxidant, i.e. oxidizing carbon monoxide to carbon dioxide, for example.

Among nano-sized additive materials, transitional metal oxides, such as iron oxide, having dual functions as a CO or NO catalyst in the presence of $O_2$ and as a CO oxidant for the direct oxidation of CO in the absence of $O_2$ are especially preferred. A catalyst which can also be used as an oxidant is especially useful for certain applications, such as within a burning cigarette, where $O_2$ is minimal and the reusability of the catalyst is not required. For instance, NANOCAT® Superfine $Fe_2O_3$, manufactured by Mach I, Inc., can be used as a catalyst and oxidant of CO oxidation.

By "nanoparticles" is meant that the particles have an average particle size of less than a micron. The manganese oxide nanoparticle mixture preferably has an average particle size less than about 500 nm, more preferably less than about 100 nm, even more preferably less than about 50 nm, and most preferably less than about 5 nm. Preferably, the manganese oxide nanoparticle mixture has a surface area from about 20 $m^2/g$ to about 400 $m^2/g$, or more preferably from about 200 $m^2/g$ to about 300 $m^2/g$.

Figure 3:
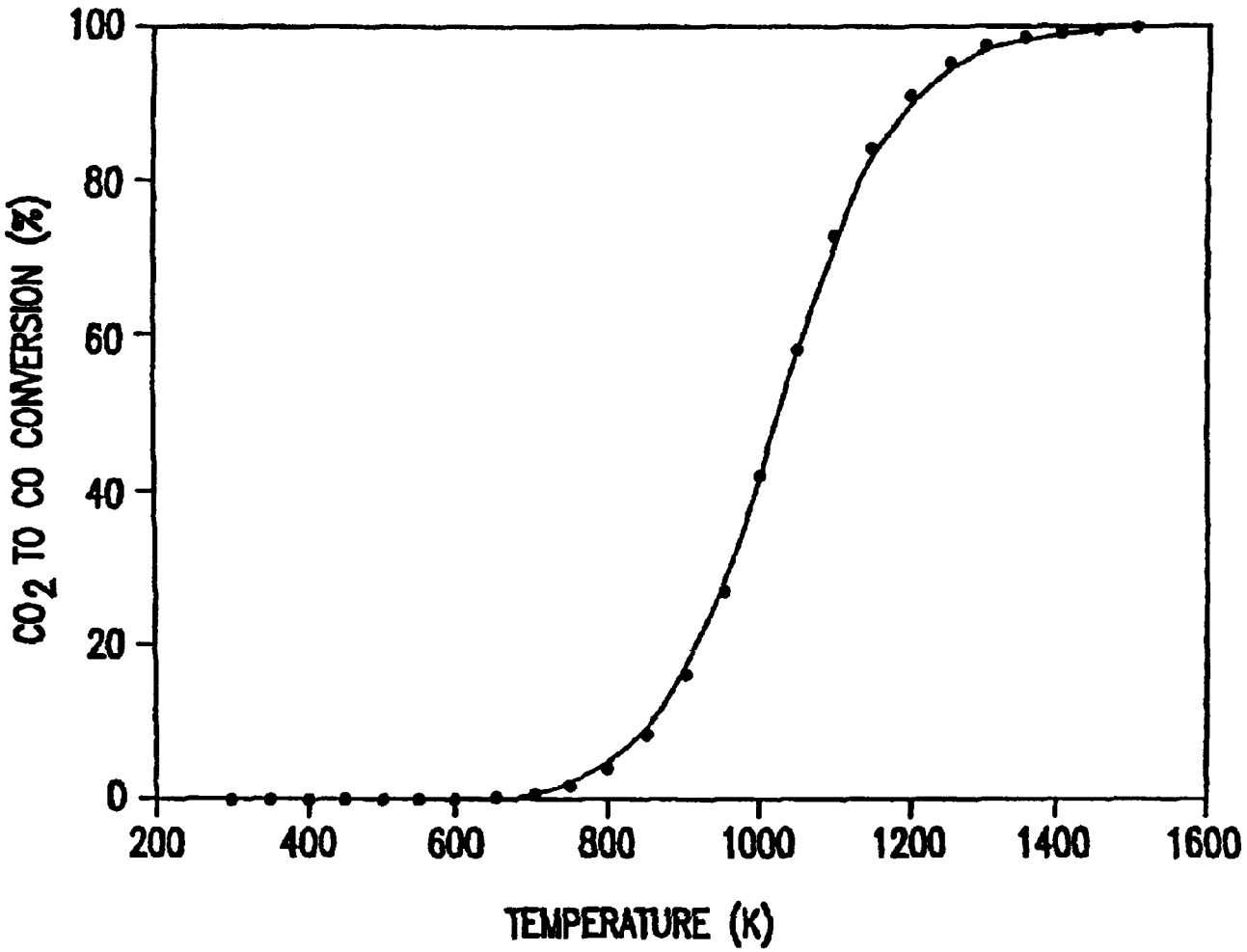
FIG. 3 depicts the predicted temperature dependence of the percentage conversion of carbon dioxide to carbon monoxide by carbon.

FIG. 1 shows a comparison between the catalytic activity of $Fe_2O_3$ nanoparticles (NANOCAT® Superfine Iron Oxide (SFIO) from MACH I, Inc., King of Prussia, Pa.) having an average particle size of about 3 nm, versus $Fe_2O_3$ powder (from Aldrich Chemical Company) having an average particle size of about 5 $\mu$m. The $Fe_2O_3$ nanoparticles show a much higher percentage of conversion of carbon monoxide to carbon dioxide than the $Fe_2O_3$ having an average particle size of about 5 $\mu$m. As shown in FIG. 3, 50 mg of the NANOCAT® $Fe_2O_3$ can catalyze more than 98% CO to $CO_2$ at 400° C. in an inlet gas mixture of 3.4% CO and 20.6% $O_2$ at 1000 ml/minute. Under identical conditions, the same amount of the $\alpha$-$Fe_2O_3$ powder with a particle size of 5 $\mu$m, can catalyze only about 10% CO to $CO_2$. In addition to that, the initial light-off temperature for NANOCAT® $Fe_2O_3$ is more than 100° C. lower than that of $\alpha$-$Fe_2O_3$ powder. The reason for the dramatic improvement of the nanoparticles over the non-nanoparticles it two fold. First, the BET surface area of the nanoparticle is much higher (250 $m^2/g$ vs. 3.2 $m^2/g$). Secondly, there are more coordination unsaturated sites on the nanoparticles surface. These are the catalytically active sites. Hence, even without changing the chemical composition, the performance of the catalyst can be increased by reducing the size of the catalyst to nanoscale.

The manganese oxide nanoparticle mixture may be made using any suitable technique, or purchased from a commercial supplier. Preferably, the selection of an appropriate manganese oxide nanoparticle mixture will take into account such factors as stability and preservation of activity during storage conditions, low cost and abundance of supply. Preferably, the manganese oxide nanoparticle mixture will contain benign materials.

Amorphous phases, synergism, and size effects in nano scale, are three factors that could improve the performance of the carbon monoxide or nitric oxide catalyst. Some nanoparticles also possess an amorphous structure. For instance, the amorphous component of NANOCAT® $Fe_2O_3$ could also contribute to its high catalytic activity.

Preferably, the manganese oxide nanoparticle mixture will include an additive in the form of iron oxide nanoparticles. For instance, MACH I, Inc., King of Prussia, Pa. sells $Fe_2O_3$ nanoparticles under the trade names NANOCAT® Superfine Iron Oxide (SFIO) and NANOCAT® Magnetic Iron Oxide. The NANOCAT® Superfine Iron Oxide (SFIO) is amorphous ferric oxide in the form of a free flowing powder, with a particle size of about 3 nm, a specific surface area of about 250 $m^2/g$, and a bulk density of about 0.05 g/mL. The NANOCAT® Superfine Iron Oxide (SFIO) is synthesized by a vapor-phase process, which renders it free of impurities that may be present in conventional catalysts, and is suitable for use in food, drugs, and cosmetics. The NANOCAT® Magnetic Iron Oxide is a free flowing powder with a particle size of about 25 nm and a surface area of about 40 $m^2/g$.

The manganese oxide nanoparticle mixture may be prepared using any suitable technique. The manganese oxide may be combined with the additive in any suitable manner. For instance, the manganese oxide may be co-precipitated with the additive or it may be mechanically mixed with the additive using any suitable method.

For example, in order to form a co-precipitate of manganese oxide with iron oxide, an aqueous solution containing iron oxide, and manganese oxide is prepared. Co-precipitation is carried out by adding $Na_2CO_3$ to this solution, slowly and with continuous stirring at room temperature. (If desired, the pH of the mixture can be continuously measured using a pH-meter to achieve an optimal pH.) Before filtering, the solution is aged for about three hours. The solution is filtered and the precipitate is washed with deionized water and dried in air at 60° C. for 20 hours. The sample is then humidity-dried at 90° C. (dry bulb) and 70° C. (wet bulb) for 8 hours. Next, the precipitate is fired in nitrogen at 600° C. for 8 hours. While, this is an example of a typical co-precipitation method, it will be apparent that certain modifications and changes may also be made to achieve the desired co-precipitate of manganese oxide.

The ratio of manganese oxide to the additive(s) in the mixtures may be any suitable value from about 1:100 and 100:1 of the manganese oxide and the additive(s) respectively, from about 20:80 and 80:20, from about 30:70 and 70:30; from about 40:60 and 60:40; or about 50:50. The relative amounts will depend upon the identity and nature of the additive, and may be adjusted accordingly to achieve optimal results with respect to removal of carbon monoxide and/or nitric oxide during smoking.

Figure 2:
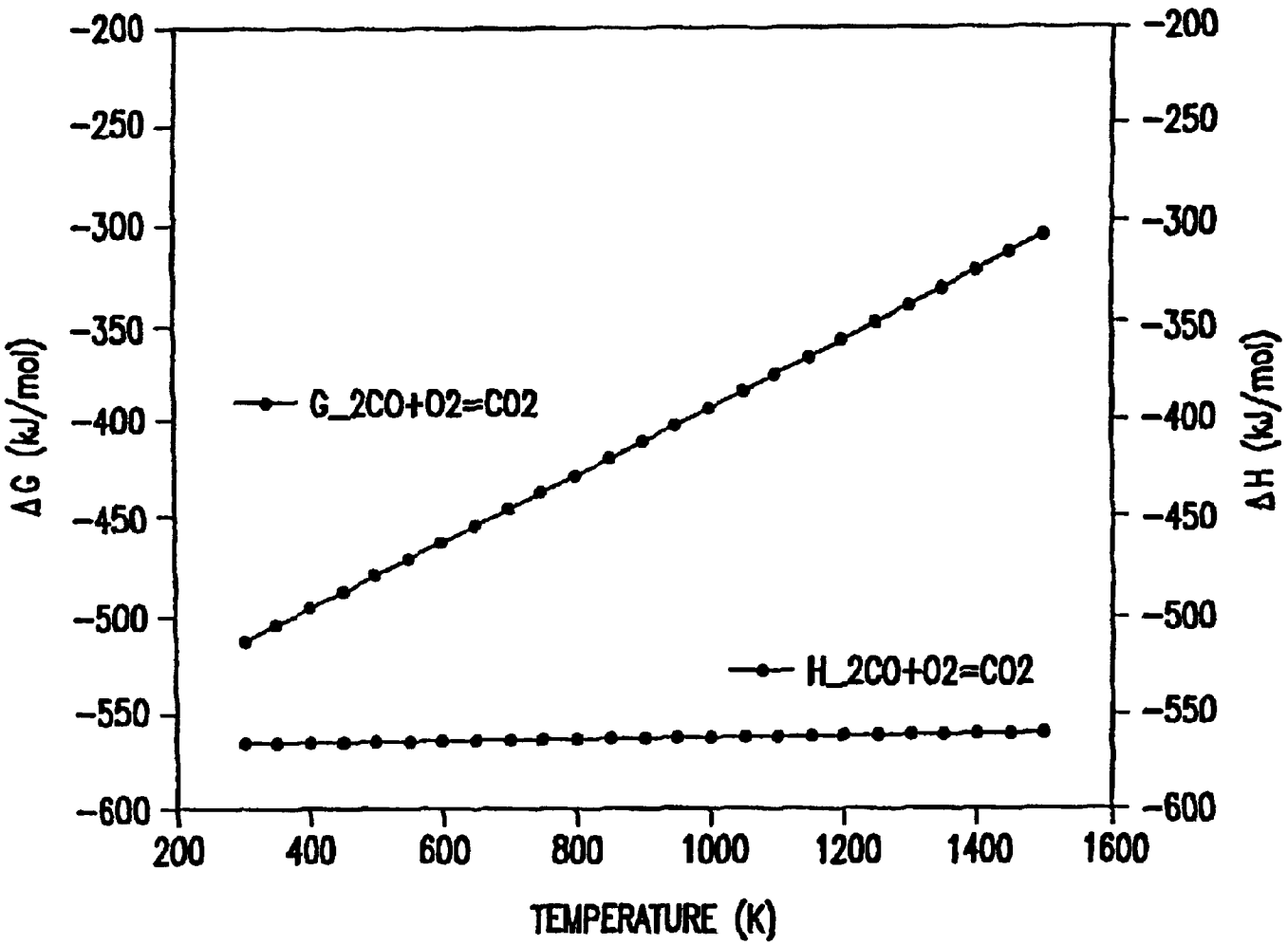
FIG. 2 depicts the predicted temperature dependence of the Gibbs Free Energy and Enthalpy for the oxidation reaction of carbon monoxide to carbon dioxide.

In selecting a manganese oxide nanoparticle mixture, various thermodynamic considerations may be taken into account, to ensure that oxidation and/or catalysis will occur efficiently. For example, various thermodynamic calculations were done to predict the thermodynamic behavior of various reactions. Based on these thermodynamic calculations, FIG. 2 shows the predicted thermodynamic analysis of the Gibbs Free Energy and Enthalpy temperature dependence for the oxidation of carbon monoxide to carbon dioxide. Also based on thermodynamic calculations, FIG. 3 shows the predicted temperature dependence of the percentage of carbon dioxide conversion with carbon to form carbon monoxide.

In a preferred embodiment, the manganese oxide nanoparticle mixture comprises at least one additive selected from the group consisting of metal oxides, doped metal oxides, and mixtures thereof. Any suitable metal oxide or doped metal oxide in the form of nanoparticles may be used. Optionally, one or more metal oxides may also be used as mixtures or in combination, where the metal oxides may be different chemical entities or different forms of the same metal oxide.

Preferred manganese oxide nanoparticle mixtures may include as the additive various metal oxides, such as $Fe_2O_3$, CuO, $TiO_2$, $CeO_2$, $Ce_2O_3$, or $Al_2O_3$, or doped metal oxides such as $Y_2O_3$ doped with zirconium, $Mn_2O_3$ doped with palladium, or mixtures of these. In particular, $Fe_2O_3$ is preferred because it can be reduced to FeO or Fe after the reaction. Moreover, use of a precious metal can be avoided, as the reduced $Fe_2O_3$ nanoparticles are economical and readily available. In particular, NANOCAT® Superfine Iron Oxide (SFIO) and NANOCAT® Magnetic Iron Oxide, described above, are preferred additives. NANOCAT® Superfine $Fe_2O_3$ can be used as catalyst or as an oxidant for CO oxidation, depending on the availability of the $O_2$.

Figure 4A:
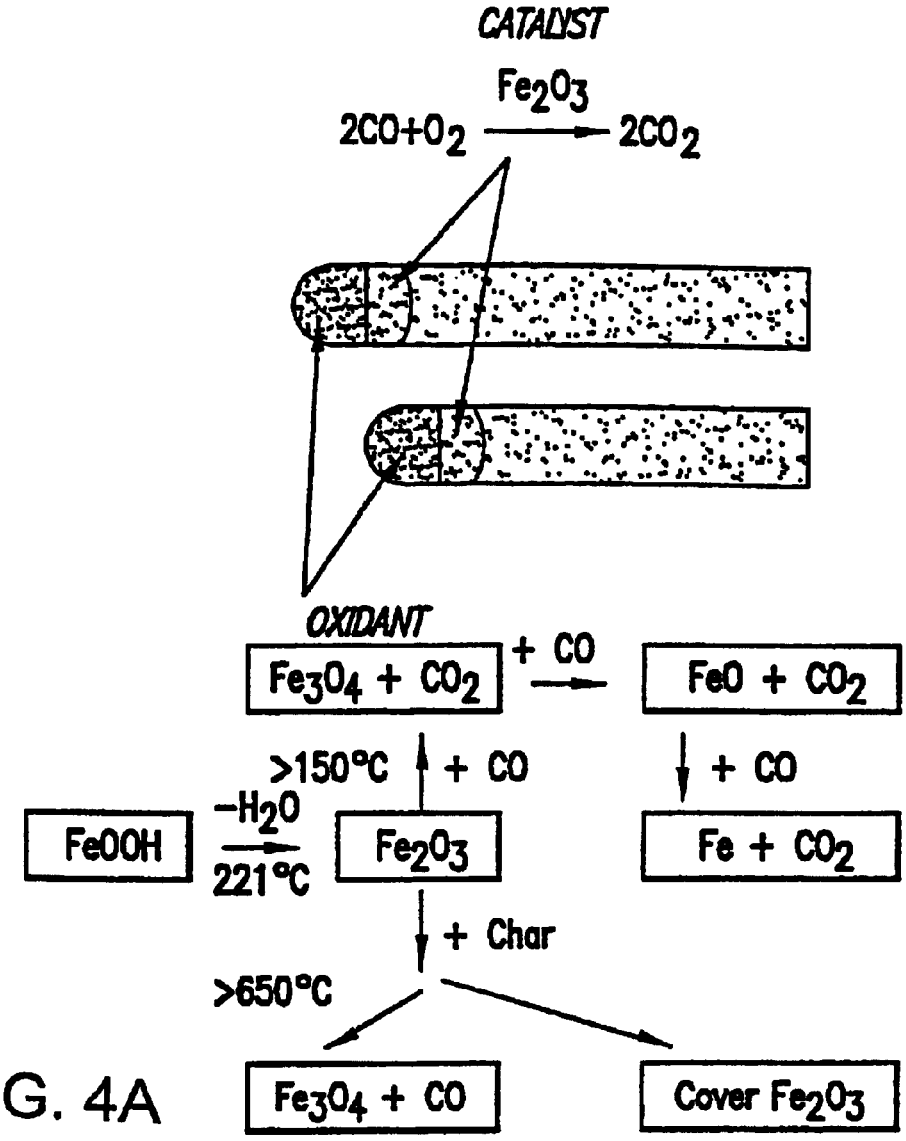
FIGS. 4A and 4B depict the pyrolysis region (where the $Fe_2O_3$ nanoparticles act as a catalyst) and the combustion zone (where the $Fe_2O_3$ nanoparticles act as an oxidant) in a cigarette.
Figure 4B:
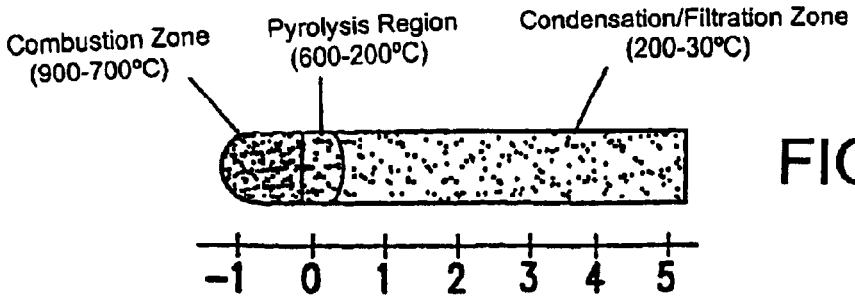

When used in manganese oxide nanoparticle mixtures, $Fe_2O_3$ nanoparticles are capable of acting as both an oxidant and catalyst for the conversion of carbon monoxide to carbon dioxide and for the conversion of nitric oxide to nitrogen. As shown schematically in FIG. 4A, the $Fe_2O_3$ nanoparticles act as a catalyst in the pyrolysis zone, and act as an oxidant in the combustion region. FIG. 4B shows various temperature zones in a lit cigarette. The oxidant/catalyst dual function and the reaction temperature range make $Fe_2O_3$ nanoparticles useful for the reduction of carbon monoxide and/or nitric oxide during smoking. Also, during the smoking of the cigarette, the $Fe_2O_3$ nanoparticles may be used initially as a catalyst (i.e. in the pyrolysis zone), and then as an oxidant (i.e. in the combustion region).

Various experiments to further study thermodynamic and kinetics of various catalysts were conducted using a quartz flow tube reactor. The kinetics equation governing these reactions is as follows:

$$ln\ (1-x)=-A_o e^{-(Ea/RT)}\cdot(s\cdot l/F)$$

where the variables are defined as follows:

x=the percentage of carbon monoxide converted to carbon dioxide $A_o$=the pre-exponential factor, $5\times10^{-6}$ $s^{-1}$ R=the gas constant, $1.987\times10^{-3}$ kcal/(mol·K)

Figure 5:
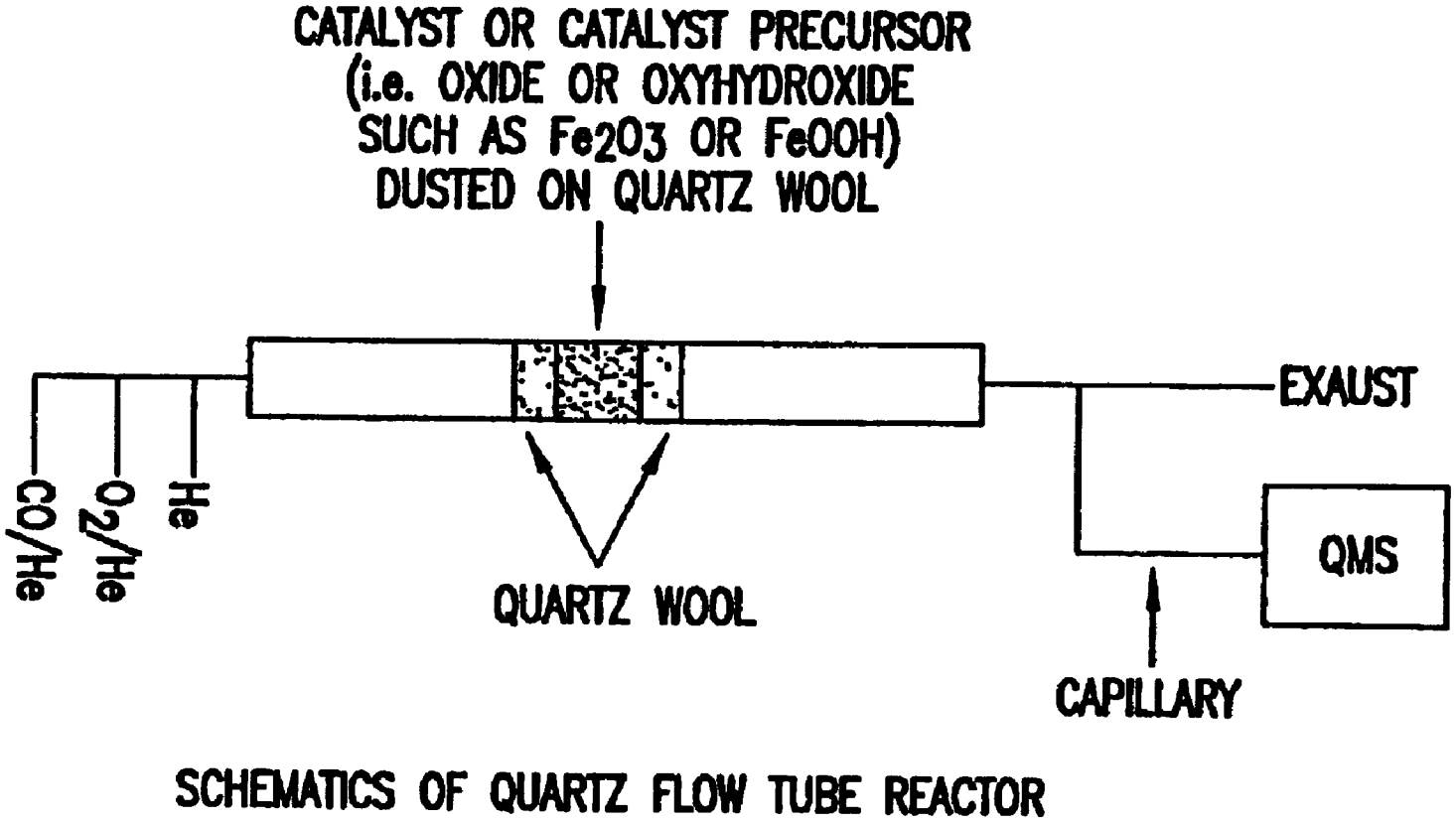
FIG. 5 depicts a schematic of a quartz flow tube reactor.

$E_a$=activation energy, 14.5 kcal/mol s=cross section of the flow tube, 0.622 $cm^2$ l=length of the catalyst, 1.5 cm F=flow rate, in $cm^3/s$ A schematic of a quartz flow tube reactor, suitable for carrying out such studies, is shown in FIG. 5. Helium, oxygen/helium and/or carbon monoxide/helium mixtures may be introduced at one end of the reactor. A quartz wool dusted with $Fe_2O_3$ nanoparticles is placed within the reactor. The products exit the reactor at a second end, which comprises an exhaust and a capillary line to a Quadrupole Mass Spectrometer ("QMS"). The relative amounts of products can thus be determined for a variety of reaction conditions.

Figure 6:
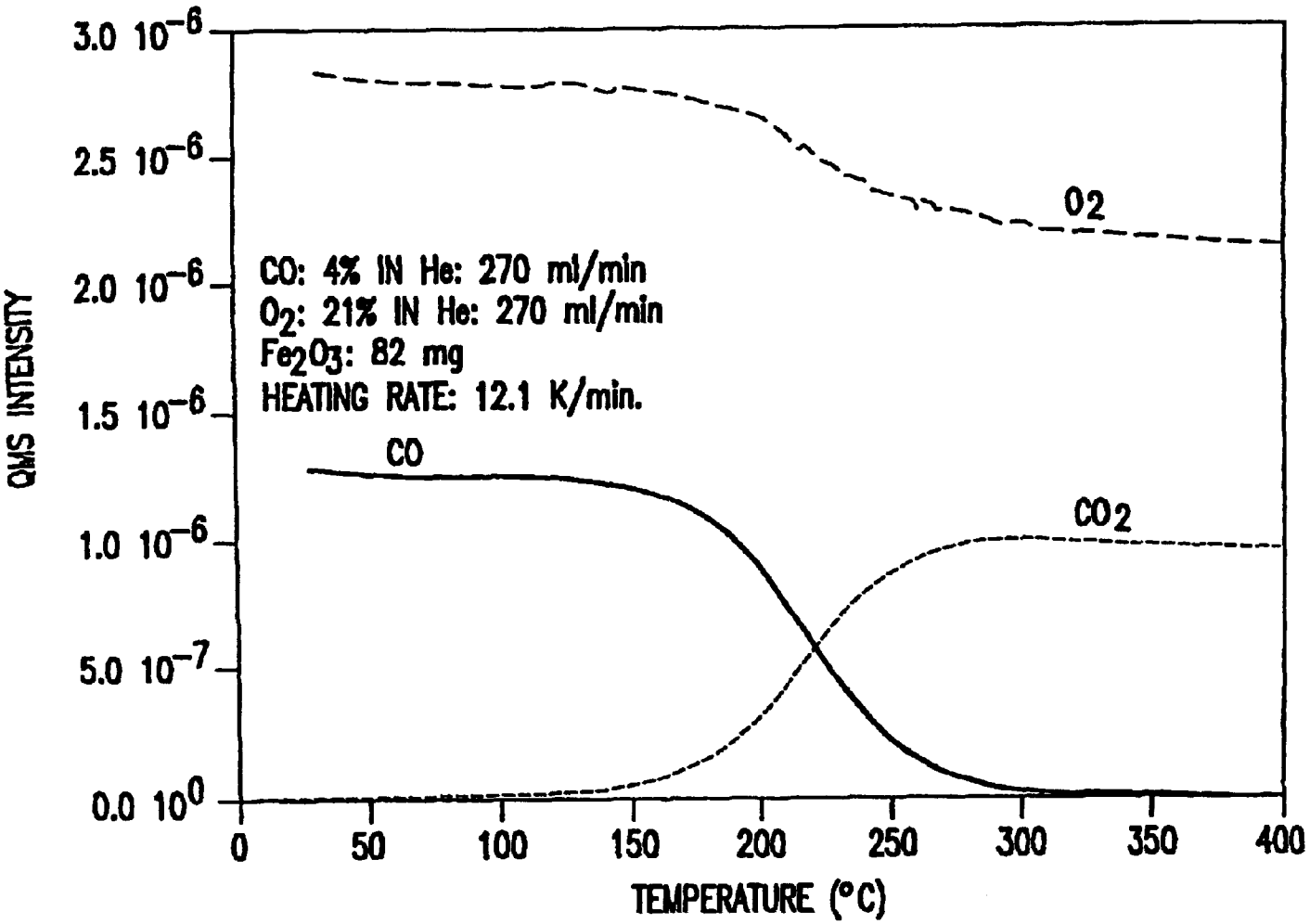
FIG. 6 illustrates the temperature dependence on the production of carbon monoxide, carbon dioxide and oxygen, when using $Fe_2O_3$ nanoparticles as the catalyst for the oxidation of carbon monoxide with oxygen to produce carbon dioxide.

FIG. 6 is a graph of temperature versus QMS intensity for a test wherein $Fe_2O_3$ nanoparticles are used as a catalyst for the reaction of carbon monoxide with oxygen to produce carbon dioxide. In the test, about 82 mg of $Fe_2O_3$ nanoparticles are loaded in the quartz flow tube reactor. Carbon monoxide is provided at 4% concentration in helium at a flow rate of about 270 mL/min, and oxygen is provided at 21% concentration in helium at a flow rate of about 270 mL/min. The heating rate is about 12.1 K/min. As shown in this graph, $Fe_2O_3$ nanoparticles are effective at catalyzing carbon monoxide to carbon dioxide at temperatures above around 225° C.

Figure 7:
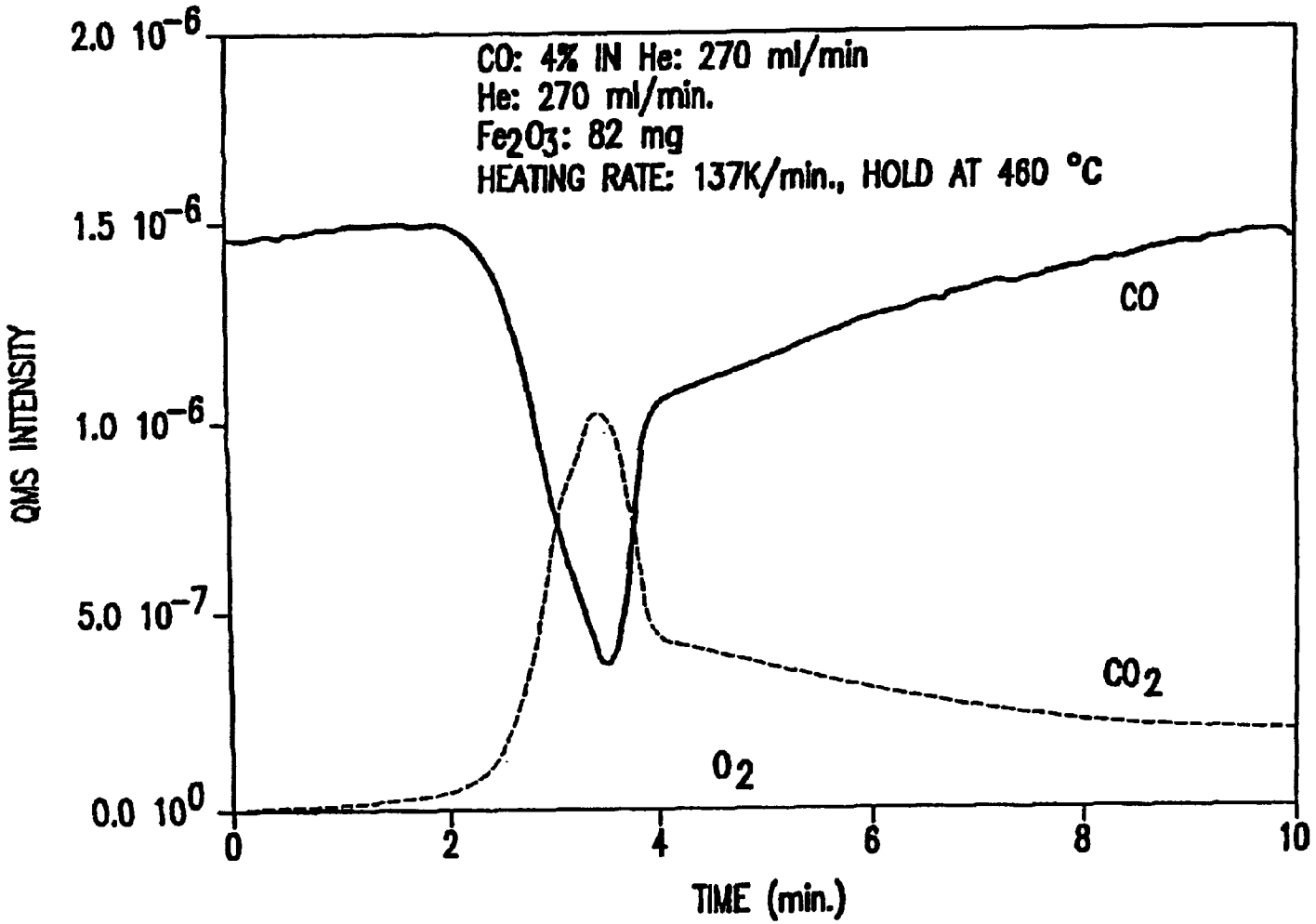
FIG. 7 illustrates the relative production of carbon monoxide, carbon dioxide and oxygen, when using $Fe_2O_3$ nanoparticles as an oxidant for the reaction of $Fe_2O_3$ with carbon monoxide to produce carbon dioxide and FeO.

An experiment was done to show that $Fe_2O_3$ nanoparticles also act as an oxidant under conditions where oxygen is not present. FIG. 7 is a graph of time versus QMS intensity for an experiment that studies $Fe_2O_3$ nanoparticles as an oxidant for the reaction of $Fe_2O_3$ with carbon monoxide to produce carbon dioxide and FeO. In the test, about 82 mg of $Fe_2O_3$ nanoparticles are loaded in the quartz flow tube reactor. Carbon monoxide is provided at 4% concentration in helium at a flow rate of about 270 mL/min, and the heating rate is about 137 K/min to a maximum temperature of 460° C. QMS intensity for carbon dioxide, carbon monoxide and oxygen is monitored over time. As shown by the graph, although the oxygen concentration is maintained around zero, carbon monoxide is still converted to carbon dioxide, because the $Fe_2O_3$ nanoparticles are acting as an oxidant. After the quantity of $Fe_2O_3$ nanoparticles is consumed, the concentrations of carbon monoxide and carbon dioxide return to their original levels.

As suggested by data shown in FIGS. 6 and 7, $Fe_2O_3$ nanoparticles are effective in conversion of carbon monoxide to carbon dioxide under conditions similar to those during smoking of a cigarette, and can act as a catalyst and/or an oxidant depending on the reaction conditions.

Figure 8A:
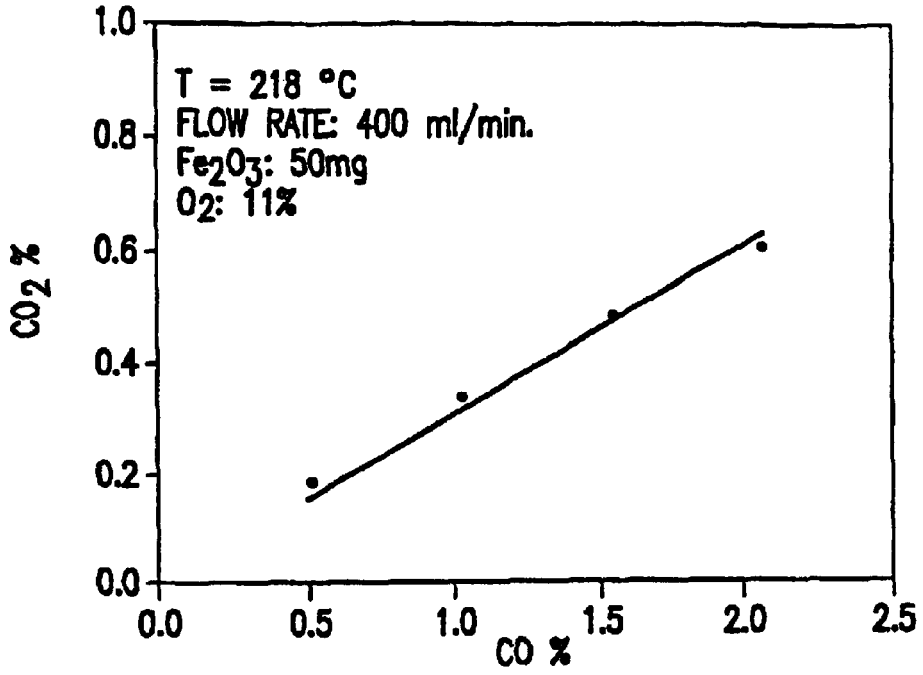
FIGS. 8A and 8B illustrate the reaction orders of carbon monoxide and carbon dioxide with $Fe_2O_3$ as a catalyst.
Figure 8B:
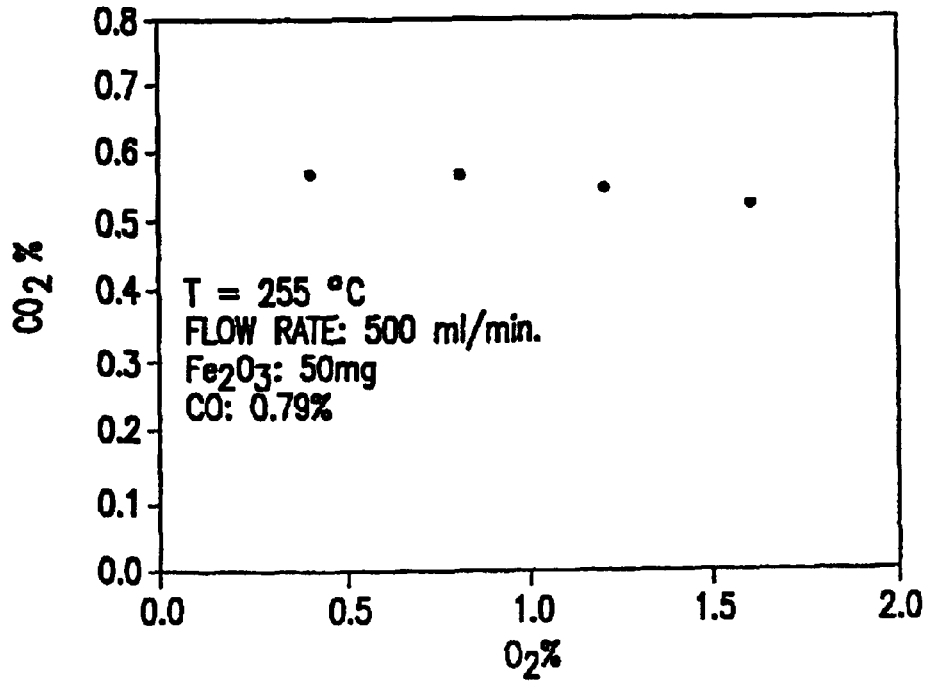

FIGS. 8A and 8B are graphs showing the reaction orders of carbon monoxide and carbon dioxide with $Fe_2O_3$ as a catalyst. The reaction order of CO was measured isothermally at 244° C. At this temperature, the CO to $CO_2$ conversion rate is about 50%. With a total flow rate of 400 ml/minute, the inlet $O_2$ was kept constant at 11% while the inlet CO concentration was varied from 0.5 to 2.0%. The corresponding $CO_2$ concentration in the outlet was recorded and the data is shown in FIG. 8A. The linear relationship between the effluent $CO_2$ concentration and the inlet CO concentration indicated that the catalytic oxidation of CO on NANOCAT® is first order to CO.

The reaction order of $O_2$ was measured in a similar fashion. Care was taken to make sure that $O_2$ concentration was not lower than ½ of the CO inlet concentration, as the stoichiometry of the reaction required. The purpose was to prevent any direct oxidation of the CO by NANOCAT® because of insufficient $O_2$. As shown in FIG. 8B, the increase of the $O_2$ concentration had very little effect on the $CO_2$ production in the effluent gas. Therefore, it can be concluded that the reaction order of $O_2$ is approximately zero.

Since the reaction is first order for CO and zero order for $O_2$, the overall reaction is a first order reaction. In the plug-flow tubular reactor, the reaction rate constant, k ($s^{-1}$), can be expressed as:

$$k=(u/v)\ ln\ (C_0/C)$$

where u is the flow rate in ml/s, V is the total volume of the catalyst in $cm^3$, $C_0$ is the volume percentage of CO in the gas inlet, C is the volume percentage of CO in the gas outlet. According to Arrhenius equation:

$$k=A\ e^{(Ea/RT)}$$

where A is the pre-exponential factor in $s^{-1}$, $E_a$ is the apparent activation energy in kJ/mol, R is the gas constant and T is the absolute temperature in ° K. Combining these equations:

$$ln[-ln(1-x)]=lnA+ln(v/u)-E_a/RT$$

where x is the CO to $CO_2$ conversion rate:

$$x=(C_0-C)/C_0$$

Figure 9:
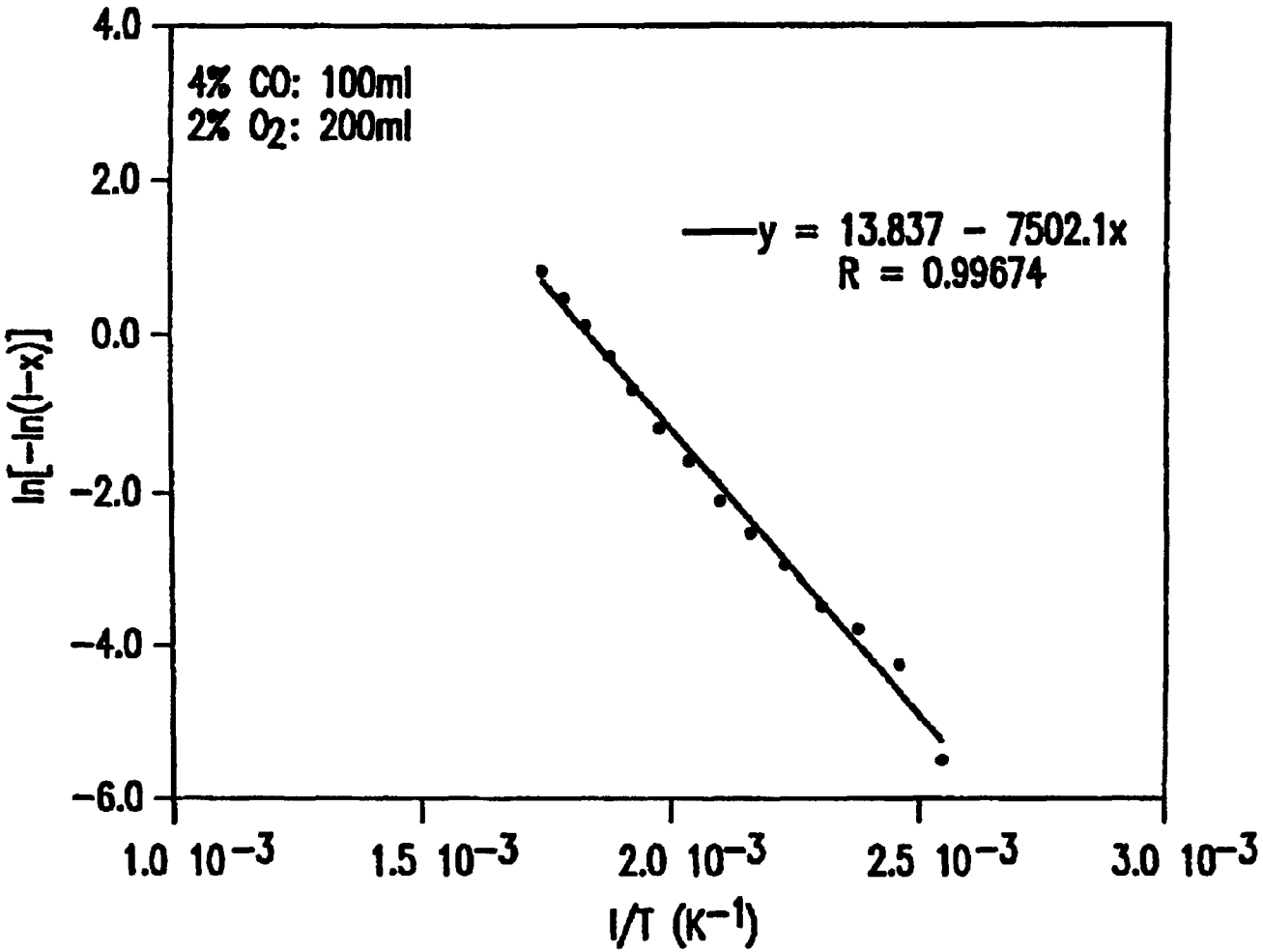
FIG. 9 depicts the measurement of the activation energy and the pre-exponential factor for the reaction of carbon monoxide with oxygen to produce carbon dioxide, using $Fe_2O_3$ nanoparticles as a catalyst for the reaction.

By plotting ln[−ln(1−x)] vs. 1/T, the apparent activation energy $E_a$ can be read from the slope and the pre-exponential factor A can be calculated from the intercept for the reaction of carbon monoxide with oxygen to produce carbon dioxide, using $Fe_2O_3$ nanoparticles as a catalyst for the reaction, as shown in FIG. 9.

The values of A and $E_a$ were measured and are tabulated in Table 1 as the first six entries, along with comparative values reported in the literature for other catalysts.

TABLE 1

Summary of the Activation Energies and Pre-exponential Factors

| | Flow Rate (mL/min) | CO% | $O_2$ % | $A_o$ ($S^{-1}$) | $E_a$ (kcal/mol) |
|---|---|---|---|---|---|
| 1 | 300 | 1.32 | 1.34 | $9.0 \times 10^7$ | 14.9 |
| 2 | 900 | 1.32 | 1.34 | $12.3 \times 10^6$ | 14.7 |
| 3 | 1000 | 3.43 | 20.6 | $3.8 \times 10^6$ | 13.5 |
| 4 | 500 | 3.43 | 20.6 | $5.5 \times 10^6$ | 14.3 |
| 5 | 250 | 3.42 | 20.6 | $9.2 \times 10^7$ | 15.3 |
| AVG. | | | | $8.0 \times 10^6$ | 14.5 |
| Gas Phase | | | | | 39.7 |

TABLE 1-continued

Summary of the Activation Energies and Pre-exponential Factors

| | Flow Rate (mL/min) | CO% | $O_2$ % | $A_o$ ($S^{-1}$) | $E_a$ (kcal/mol) |
|---|---|---|---|---|---|
| 2% $Au/TiO_2$ | | | | | 7.6 |
| 2.2% $Pd/Al_2O_3$ | | | | | 9.6 |
| $Fe_2O_3$ | | | | | 26.4 |
| $Fe_2O_3/TiO_2$ | | | | | 19.4 |
| $Fe_2O_3/Al_2O_3$ | | | | | 20.0 |

The measured average $E_a$ of 14.5 kcal/mol for the $Fe_2O_3$ nanoparticles is less than activation energy reported for the gas phase of 39.7 kcal/mol (as reported in K. M. Bryden, and K. W. Ragland, *Energy & Fuels,* 10, 269 (1996)). This result indicates that $Fe_2O_3$ nanoparticles act as a catalyst, i.e. that they lower the Ea for this reaction. In comparison to other catalysts, an Ea of about 14.5 kcal/mol is larger than the typical activation energy reported for the supported precious metal catalyst 2% $Au/TiO_2$, (<10 Kcal/mol) (as reported by Cant, N. W., N. J. Ossipoff, *Catalysis Today,* 36, 125, (1997)). However, the Ea is smaller than those of non-nanoparticle $Fe_2O_3$ catalysts listed in Table 1, such as $Fe_2O_3$, $Fe_2O_3/TiO_2$, or $Fe_2O_3/Al_2O_3$, which are all ≈20 kcal/mol (as reported in Choi, K. I. and M. A. Vance, *J. Catal.,* 131, 1, (1991) and Walker, J. S., G. I. Staguzzi, W. H. Manogue, and G. C. A. Schuit, *J. Catal.,* 110, 299 (1988)).

Figure 10:
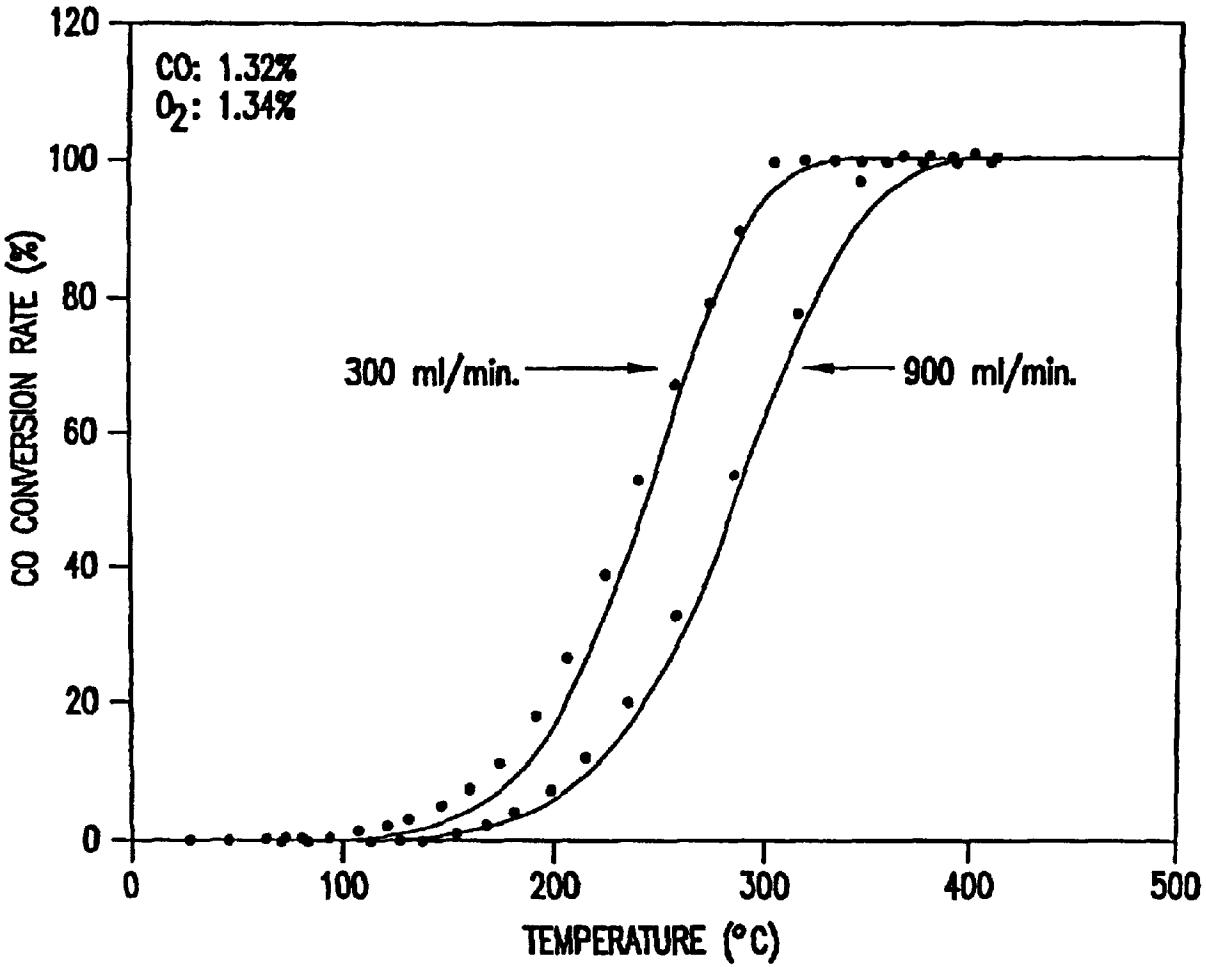
FIG. 10 depicts the temperature dependence for the conversion rate of carbon monoxide, for flow rates of 300 mL/min and 900 mL/min respectively.

FIG. 10 depicts the temperature dependence for the conversion rate of carbon monoxide using 50 mg $Fe_2O_3$ nanoparticles as catalyst in the quartz tube reactor, for flow rates of 300 mL/min and 900 mL/min respectively.

Figure 11:
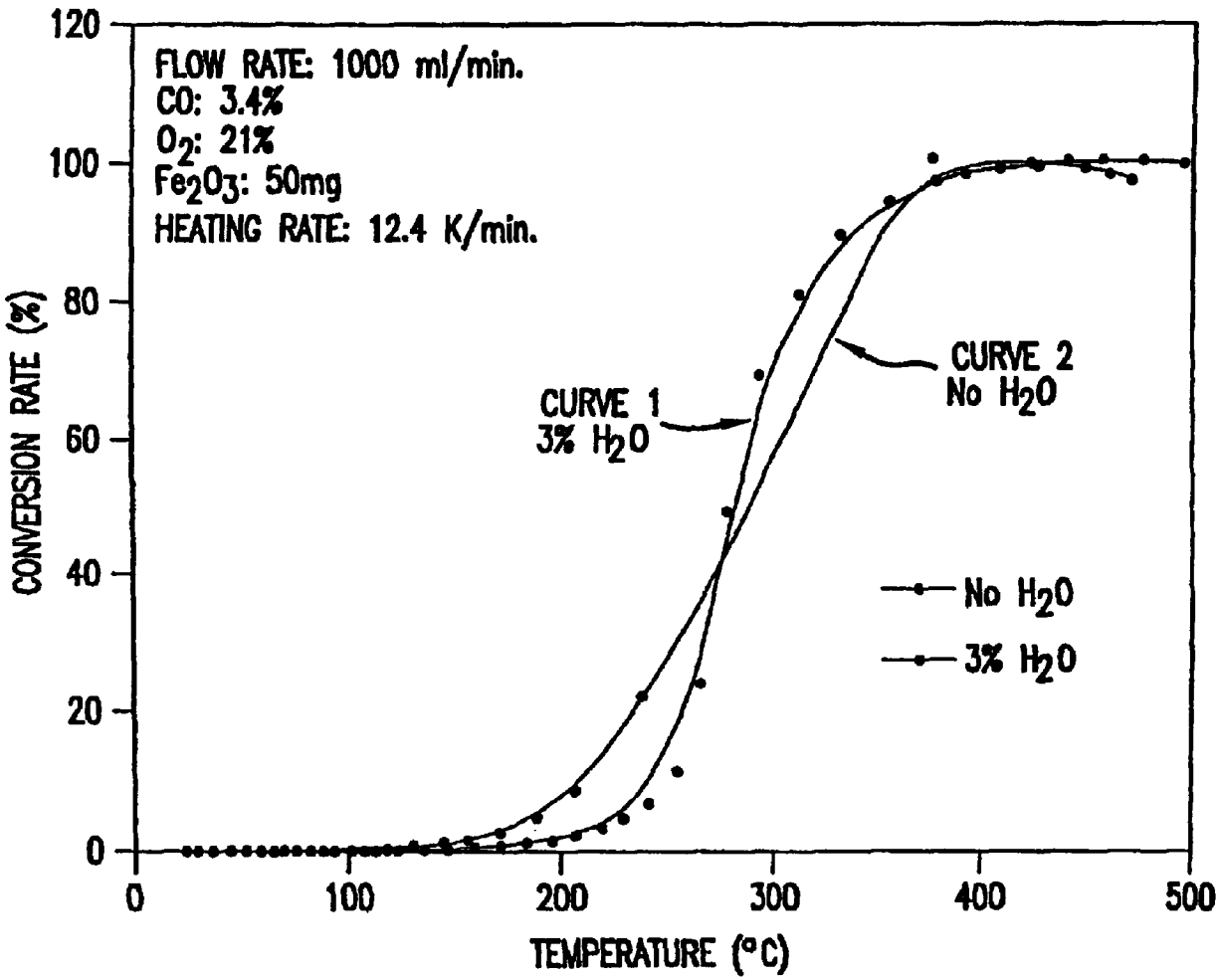
FIG. 11 depicts contamination and deactivation studies for water wherein curve 1 represents the condition for 3% $H_2O$ and curve 2 represents the condition for no $H_2O$.

FIG. 11 depicts contamination and deactivation studies for water using 50 mg $Fe_2O_3$ nanoparticles as catalyst in the quartz tube reactor. As can be seen from the graph, compared to curve 1 (without water), the presence of up to 3% water (curve 2) has little effect on the ability of $Fe_2O_3$ nanoparticles to convert carbon monoxide to carbon dioxide.

Figure 12:
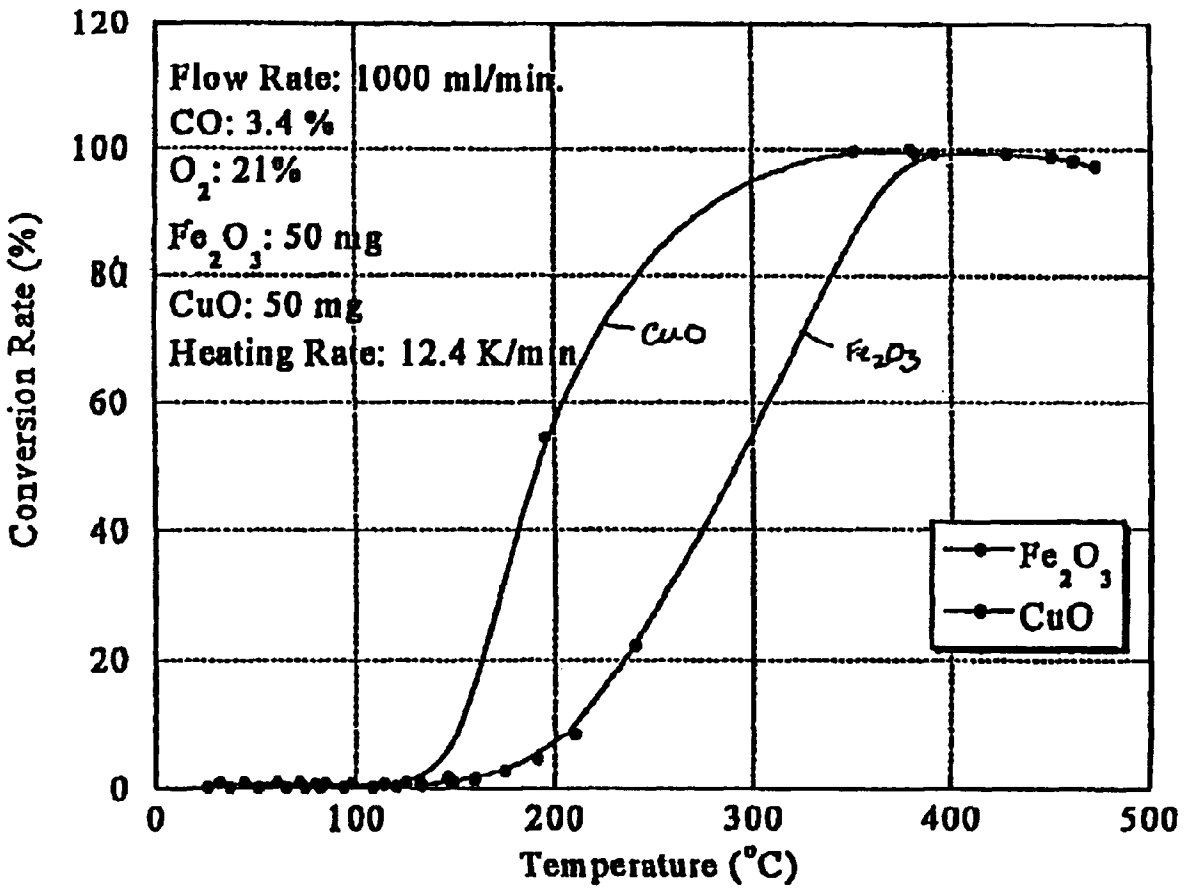
FIG. 12 depicts the temperature dependence for the conversion rates of CuO and $Fe_2O_3$ nanoparticles as catalysts for the oxidation of carbon monoxide with oxygen to produce carbon dioxide.

FIG. 12 illustrates a comparison between the temperature dependence of conversion rate for CuO and $Fe_2O_3$ nanoparticles using 50 mg $Fe_2O_3$ and 50 mg CuO nanoparticles as catalyst in the quartz tube reactor. Although the CuO nanoparticles have higher conversion rates at lower temperatures, at higher temperatures, the CuO and $Fe_2O_3$ have the same conversion rates.

Figure 13:
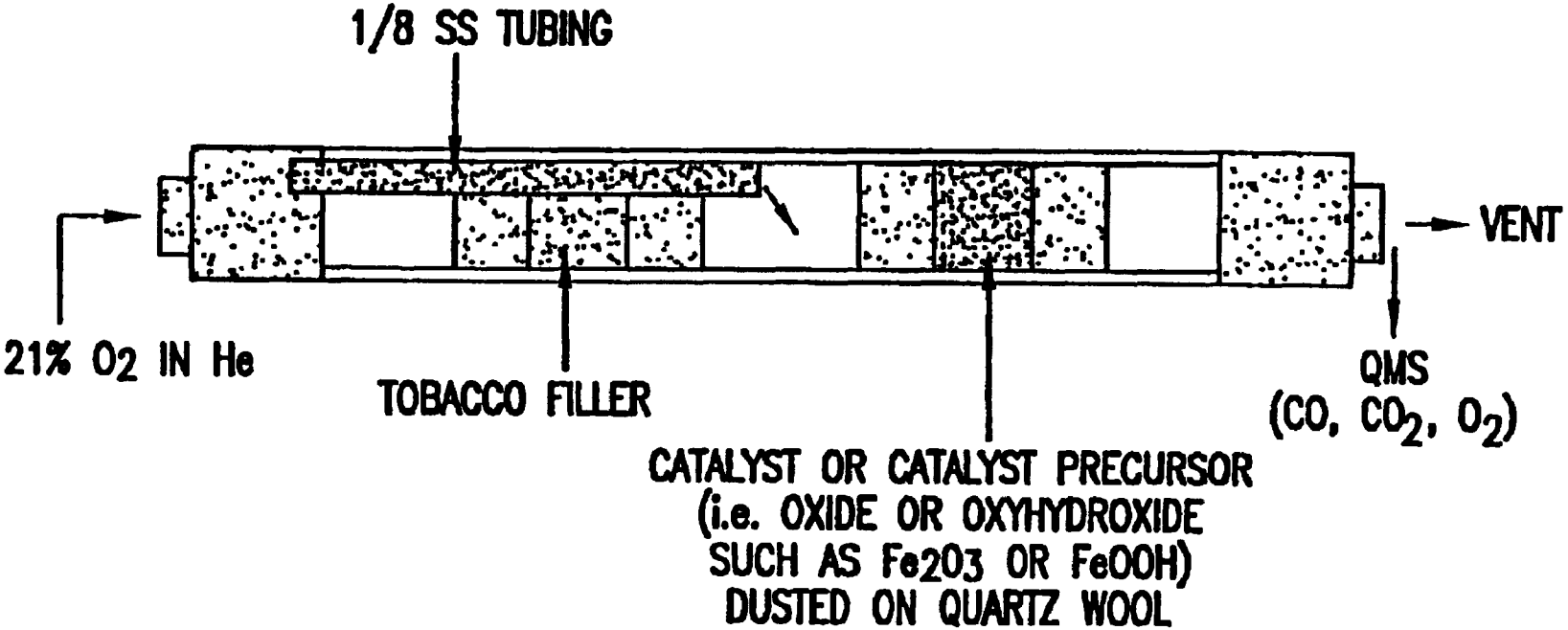
FIG. 13 depicts a flow tube reactor to simulate a cigarette in evaluating different nanoparticle catalysts.

FIG. 13 shows a flow tube reactor to simulate a cigarette in evaluating different nanopaticle catalysts. Table 2 shows a comparison between the ratio of carbon monoxide to carbon dioxide, and the percentage of oxygen depletion when using CuO, $Al_2O_3$, and $Fe_2O_3$ nanoparticles.

TABLE 2

Comparison between CuO, $Al_2O_3$, and $Fe_2O_3$ nanoparticles

| Nanoparticle | $Co/Co_2$ | $O_2$ Depletion (%) |
|---|---|---|
| None | 0.51 | 48 |
| $Al_2O_3$ | 0.40 | 60 |
| CuO | 0.29 | 67 |
| $Fe_2O_3$ | 0.23 | 100 |

In the absence of nanoparticles, the ratio of carbon monxide to carbon dioxide is about 0.51 and the oxygen depletion is about 48%. The data in Table 2 illustrates the improvement obtained by using nanoparticles. The ratio of carbon monoxide to carbon dioxide drops to 0.40, 0.29, and 0.23 for $Al_2O_3$, CuO and $Fe_2O_3$ nanoparticles, respectively. The oxygen depletion increases to 60%, 67% and 100% for $Al_2O_3$, CuO and $Fe_2O_3$ nanoparticles, respectively.

Figure 14:
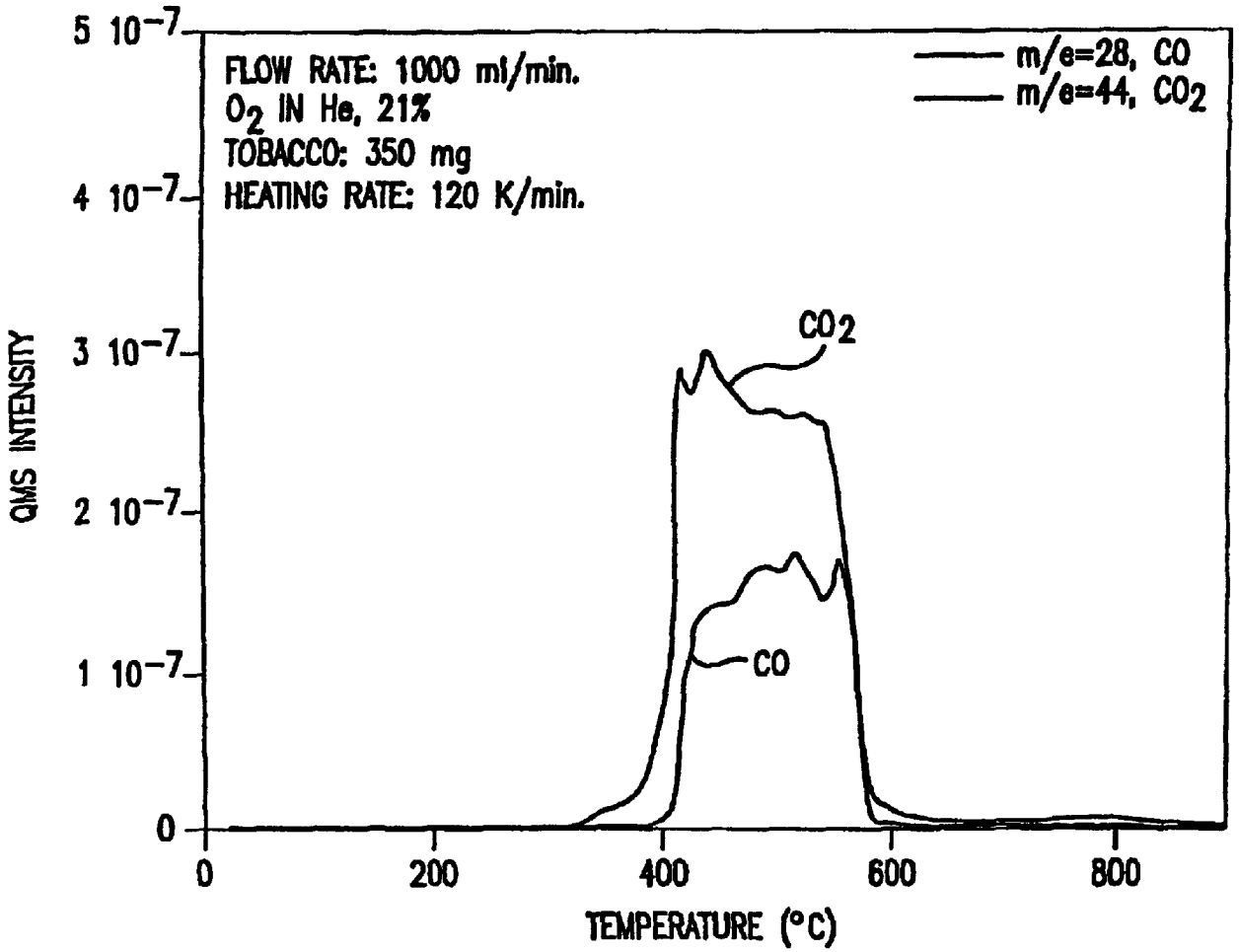
FIG. 14 depicts the relative amounts of carbon monoxide and carbon dioxide production without a catalyst present.
Figure 15:
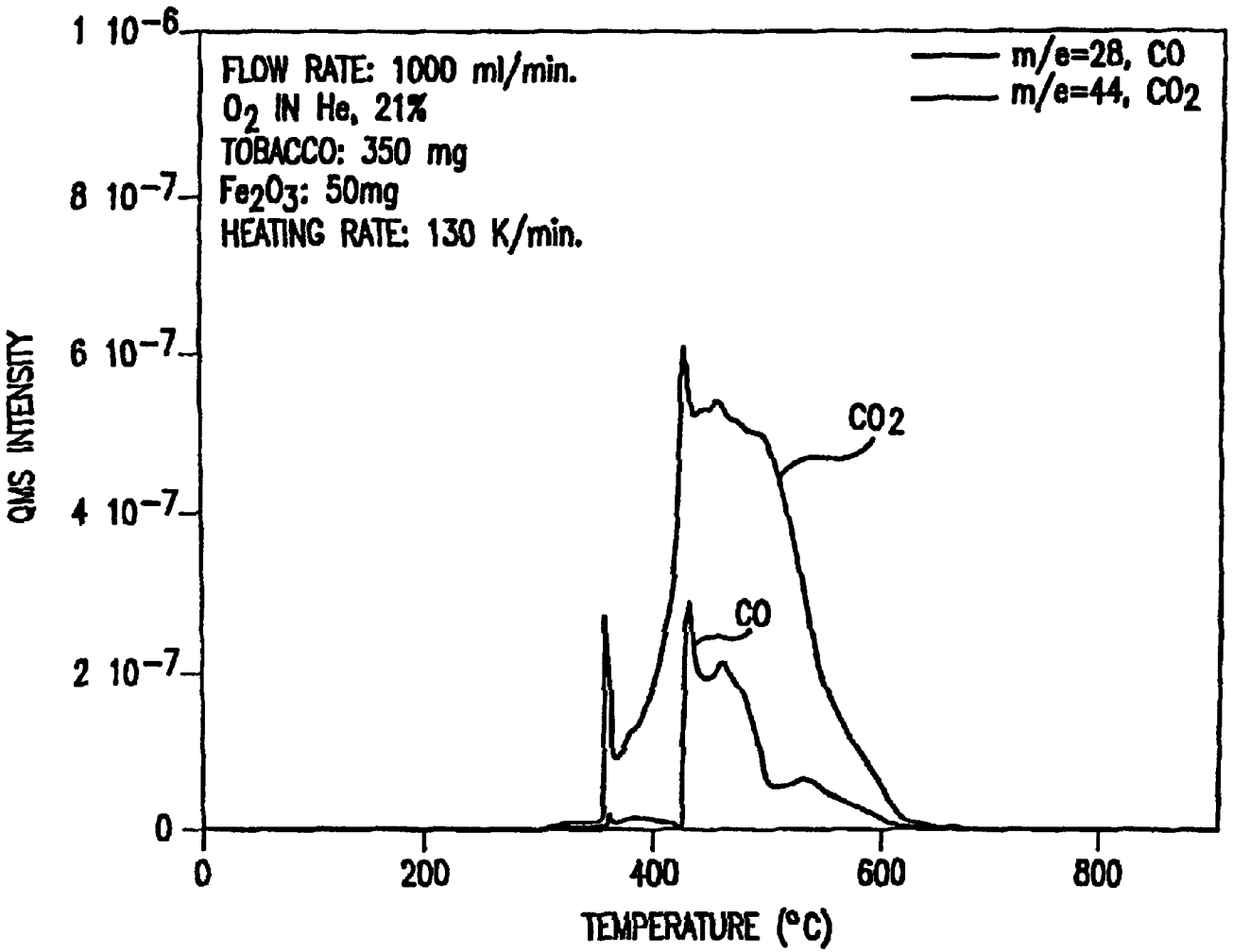
FIG. 15 depicts the relative amounts of carbon monoxide and carbon dioxide production with a catalyst present.

FIG. 14 is a graph of temperature versus QMS intensity in a test which shows the amounts of carbon monoxide and carbon dioxide production without a catalyst present. FIG. 15 is a graph of temperature versus QMS intensity in a test which shows the amounts of carbon monoxide and carbon dioxide production when using $Fe_2O_3$ nanoparticles as a catalyst. As can be seen by comparing FIG. 14 and FIG. 15, the presence of $Fe_2O_3$ nanoparticles increases the ratio of carbon dioxide to carbon monoxide present, and decreases the amount of carbon monoxide present.

In the absence of the $O_2$, $Fe_2O_3$ can also behave as a reagent to oxidize the CO to $CO_2$ with sequential reduction of the $Fe_2O_3$ to produce reduced phase such as $Fe_3O_4$, FeO and Fe. This property is useful in certain potential applications, such as a burning cigarette, where the $O_2$ is insufficient to oxidize all the CO present. The $Fe_2O_3$ can be used as a catalyst first, then again used as an oxidant and destroyed. In this way, the maximum amount of CO can be converted to $CO_2$ with only a minimal amount of $Fe_2O_3$ added.

The reaction of $Fe_2O_3$ with CO in absence of $O_2$ involves a number of steps. First, the $Fe_2O_3$ will be reduced stepwise to Fe, as the temperature increases, $$3Fe_2O_3+CO \approx 2Fe_3O_4+CO_2 \quad (5)$$

$$2Fe_3O_4+2CO \approx 6FeO+2CO_2 \quad (6)$$

$$6FeO+6CO \approx 6Fe+6CO_2 \quad (7)$$

The total equation is:

$$Fe_2O_3+3CO\ 2Fe+3CO_2 \quad (8)$$

The proportions of CO consumed in these three steps described by equations (5), (6), and (7) are 1:2:6. The freshly formed Fe can catalyze the disproportional reaction of CO. The reaction produces $CO_2$ and a carbon deposit, $$2CO \approx C+CO_2 \quad (9)$$

The carbon can also react with the Fe to form iron carbides, such as $Fe_3C$, and thus poisons the Fe catalyst. Once the Fe is completely transformed to iron carbide or its surface is completely covered by iron carbide or carbon deposit, then the disproportional reaction of CO stops.

Figure 16:
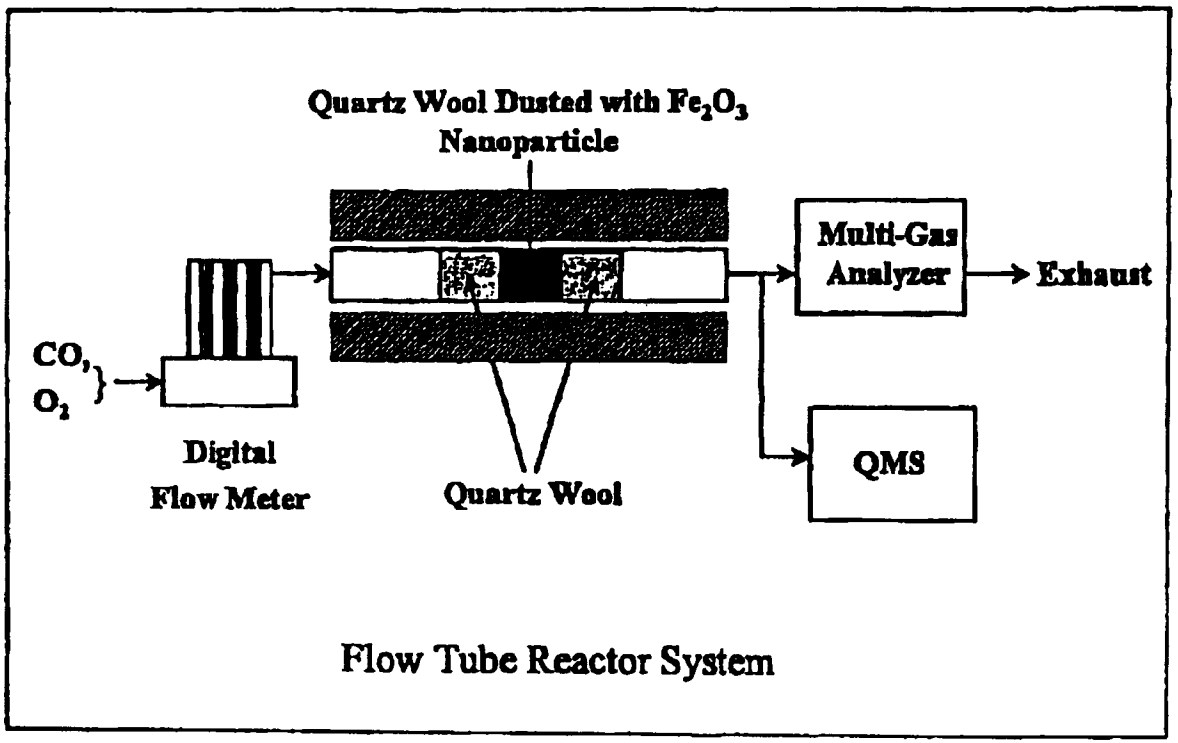
FIG. 16 depicts a flow tube reactor system with a digital flow meter and a multi-gas analyzer.
Figure 17:
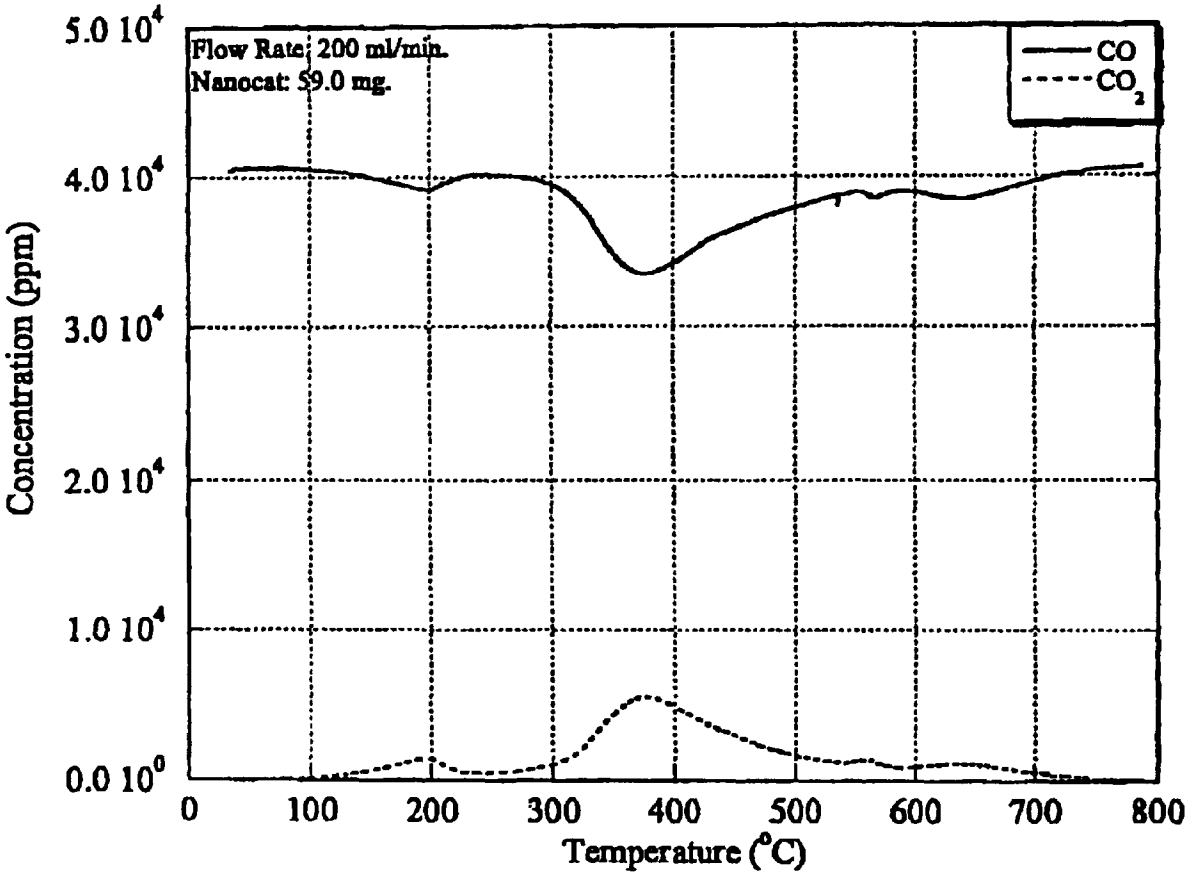
FIG. 17 depicts the production of $CO_2$ and the depletion of CO.
Figure 18:
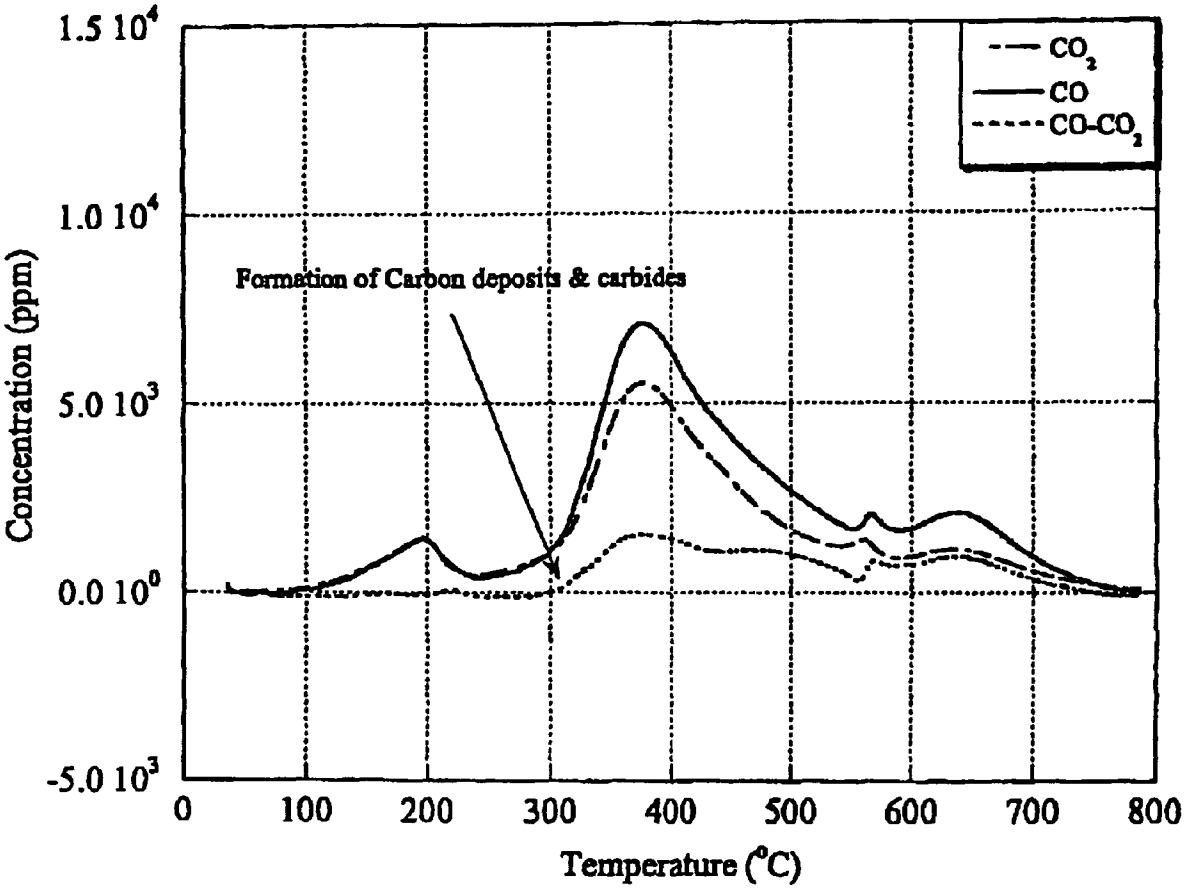
FIG. 18 depicts the depletion of CO and the production of $CO_2$, as well as the difference between the CO depletion and the $CO_2$ production, as indicated by the dashed line.

For the direct oxidation experiment, the quartz flow tube reactor shown in FIG. 16 was used. Only 4% CO balanced by helium was used in the gas inlet. The CO and $CO_2$ concentration were monitored in the effluent gas while the temperature was increased linearly from ambient to 800° C. The production of $CO_2$ and the depletion of CO are almost mirror images, as shown in FIG. 17. However, a more careful comparison in FIG. 18 shows that the depletion of CO and the production of $CO_2$ are not exactly overlapped. There is more CO depleted than $CO_2$ produced. The difference between the CO depletion and the $CO_2$ production, as indicated by the dashed line in FIG. 18, starts to appear at 300° C. and extends all the way to 800° C. All the CO reactions with different forms of iron oxides, as illustrated by equations (5), (6) and (7), would produce the same amount of $CO_2$ as the amount CO consumed. However, for the disproportionation reaction of CO catalyzed by the reduced forms of iron oxides as shown in equation (9), the CO consumed would be more than the $CO_2$ produced, and there should be carbon deposited on the surface.

Figure 19:
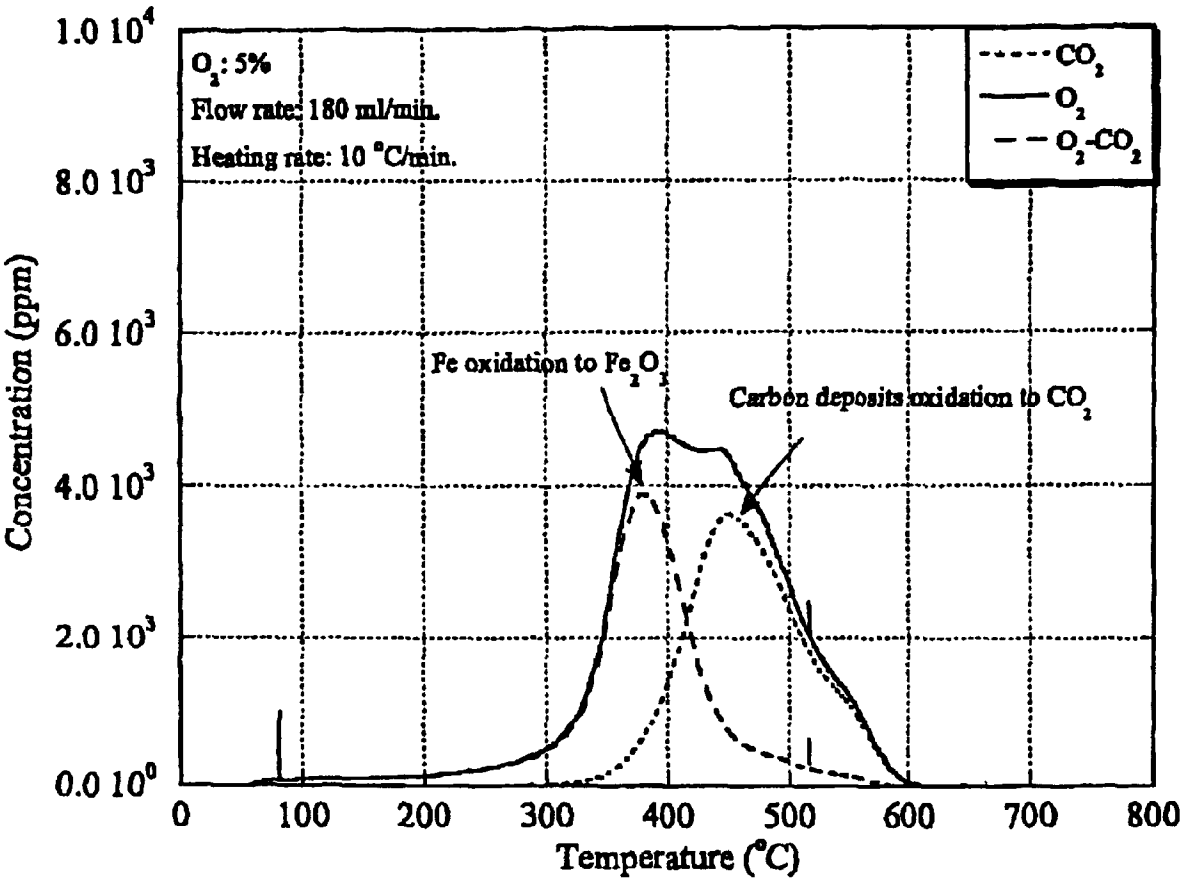
FIG. 19 depicts the net loss of $O_2$ and the production of the $CO_2$, and the difference between the amount of oxygen and the amount of carbon dioxide.

To confirm the existence of the carbon deposit, the reactor was first cooled down from 800° C. to room temperature under the inert atmosphere of helium gas. Then the inlet gas was switched to 5% of $O_2$ in helium and the reactor temperature was again linearly ramped up to 800° C. The net loss of $O_2$, the production of the $CO_2$, and the difference between the amount of oxygen and the amount of carbon dioxide are shown in FIG. 19. The reactions that occurred are:

$$C+O_2 \approx CO_2 \quad (10)$$

$$4Fe+3O_2 \approx 2Fe_3O_3 \quad (11)$$

and/or $$4Fe_3C+13O_2 \approx 6Fe_2O_3+4CO_2 \quad (12)$$

The production of $CO_2$ confirms the existence of the carbon in the sample. The difference between the net loss of $O_2$ and the production of $CO_2$ is the $O_2$ used to oxidize the Fe back to $Fe_2O_3$. This was also supported by the color change of the sample from black to bright red.

As further check, a sample heated to 800° C. in the presence of CO and He was quenched and examined with high-resolution TEM with energy dispersive spectroscopy. Essentially two phases were observed, and iron-rich phase and carbon. HRTEM images of $Fe_2O_3$ heated to 800° C. in the presence of CO show graphite surrounding iron carbide. The iron-rich phase formed a nucleus for the precipitation of carbon. The lattice fringes of the carbon have a 3.4 Å spacing, verifying that the carbon is graphite. The iron-rich core produced EDS spectra indicating only the presence of iron and carbon. Lattice fringes could be indexed as the metastable iron carbide $Fe_7C_3$ with Pnma symmetry. A hard mass was found on the bottom of the reactor table. Examination of this material in the TEM indicated that it consisted of a mixture of iron carbide, graphite, and essentially pure iron.

The CO disproportionation reaction is therefore effective in CO removal. A detailed stoichimetric account of the reduction and oxidation reactions is given in Table 3.

TABLE 3

The Stoichiometery of the Co + $Fe_2O_3$ Reaction (unit:mmole)

| | CO + $Fe_2O_3$ reaction | | |
|---|---|---|---|
| Species | Measured | Theoretical | Description |
| $Fe_2O_3$ | 0.344 | | 59.0 mg of NANOCAT ® $Fe_2O_3$ with 7% wt. of water, as measured by TG |
| $CO_{TOTAL}$ | 2.075 | | Total CO consumption |

TABLE 3-continued

The Stoichiometery of the Co + $Fe_2O_3$ Reaction (unit:mmole)

| Species | Measured | Theoretical | Description |
|---|---|---|---|
| | CO + $Fe_2O_3$ reaction | | |
| $CO_{2\ TOTAL}$ | 1.551 | | Total $CO_2$ production |
| $C = CO_{2\ TOTAL} - CO_{TOTAL}$ | 0.524 | | Total carbon in the residue |
| $CO_{2\ DISPROP.} = C$ | 0.524 | | $CO_2$ produced from the disproportional reaction according to equation (9) |
| $CO_{2\ Fe2O3} = CO2\ TOTAL - CO_{2\ DISPROP}$ | 1.027 | 1.032 | $CO_2$ produced according to equations (5), (6) and (7). |
| | $O_2$ + Fe, C Reaction | | |
| $O_{2\ TOTAL}$ | 1.060 | | Total oxygen consumption in the oxidation reaction. |
| $CO_2$ | 0.564 | | $CO_2$ production from the oxidation of carbon deposit |
| $C = CO_2$ | 0.564 | | Total carbon content in the residues |
| $O_{2\ Fe2O3} = O_{2\ TOTAL} - C$ | 0.496 | 0.516 | The oxygen used to oxidize Fe to $Fe_2O_3$. |

In the CO+$Fe_2O_3$ reaction, the difference between the total CO consumption ($CO_{TOTAL}$) and the total $CO_2$ production ($CO_{2,\ TOTAL}$) of 0.524 mmol can be attributed to the formation of the carbon deposits and iron carbides according to equation (9). This is in reasonable agreement with the 0.564 mmol determined by the oxidation of the reaction residue. The $CO_2$ produced from the reduction of $Fe_2O_3$ ($CO_{2,Fe2O3}$), is the difference between the $CO_{2,\ TOTAL}$ and the $CO_2$ produced from the CO disproportionation reaction ($CO_{2,\ DISPROP}$). The 1.027 mmol of $CO_{2,\ Fe2O3}$ agrees very well with the 1.032 mmol calculated from the initial amount of $Fe_2O_3$, according to equation (8). In the $O_2$+Fe, $Fe_3C$, and C oxidation reactions, the $O_2$ spent on the oxidation of the Fe species to $Fe_2O_3$ also agrees very well with the $O_2$ needed as calculated from the equations (11) and (12).

The total CO consumed ($CO_{TOTAL}$) of 2.075 mmol is more than double that of the CO consumed (1.027 mmol) by equation (8). Regarding the extra CO consumption, 50% became carbon deposits and carbides, and the other 50% became $CO_2$. Therefore, the contribution of the CO disproportionation reaction to the total CO removal is significant.

These experimental results show that NANOCAT® $Fe_2O_3$ is both a CO catalyst and a CO oxidant. As a catalyst, the reaction order is first order of CO and zero order for $O_2$. The apparent activation energy is 14.5 Kcal/mol. Due to its small particle size, the NANOCAT® $Fe_2O_3$ is an effective catalyst for CO oxidation, with a reaction rate of 19 $s^{-1}$ $m^{-2}$. In absence of $O_2$, the NANOCAT® $Fe_2O_3$ is an effective CO oxidant, as it can directly oxidize the CO to $CO_2$.

In addition, during the direct oxidation process, the reduced form of NANOCAT® $Fe_2O_3$ catalyzed the disproportionation reaction of CO, producing carbon deposits, iron carbide and $CO_2$. The disproportionation reaction of CO contributes significantly to the total removal of CO.

Figure 20:
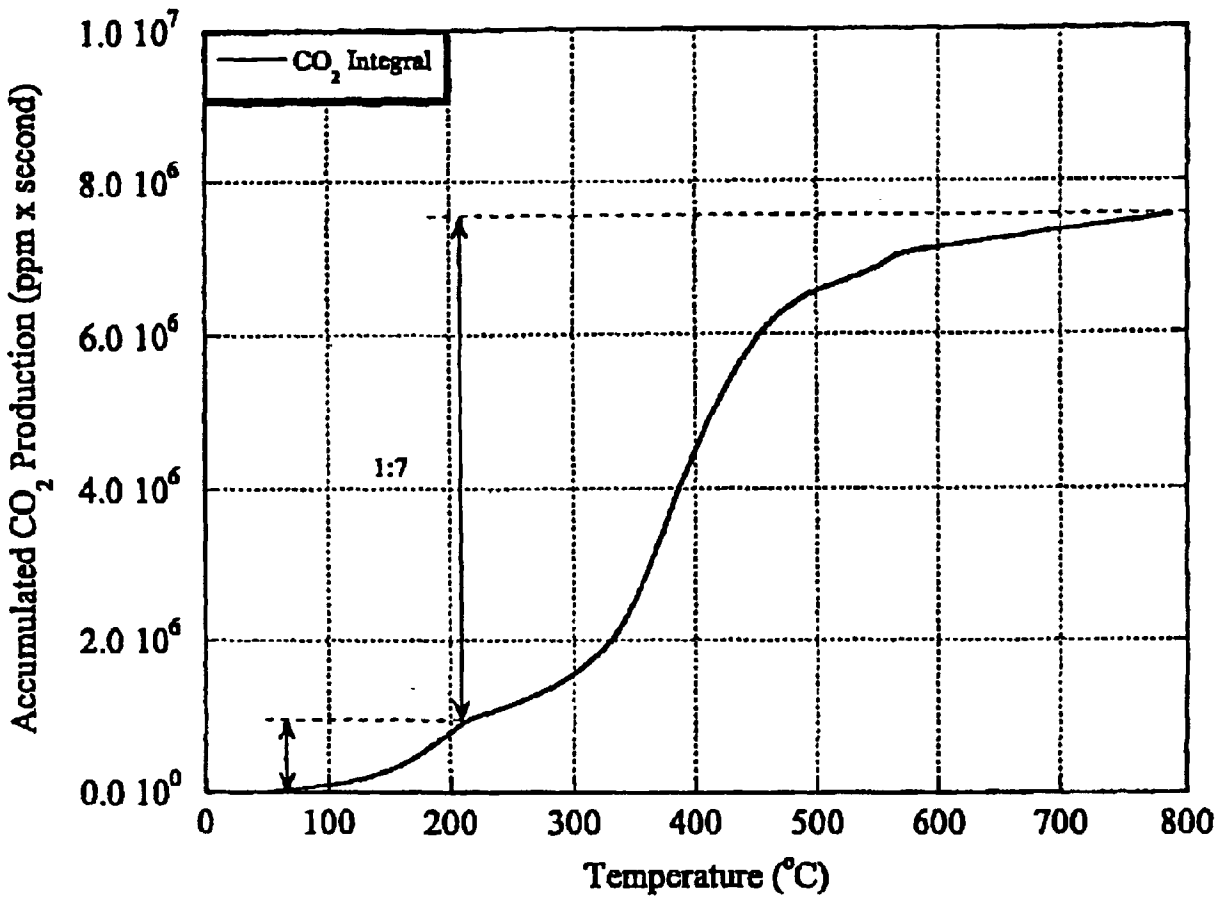
FIG. 20 depicts the expected stepwise reduction of NANOCAT® $Fe_2O_3$.

Thus, when using iron oxide nanoparticles, the amount of CO and NO can therefore be reduced by three potential reactions: the oxidation, catalysis or disproportionation. The expected stepwise reduction of NANOCAT® $Fe_2O_3$ is illustrated in FIG. 20. According to equations (5), (6) and (7), the ratio of $CO_2$ produced in these three steps is 1:2:6. However, in FIG. 20, only two steps can be observed with a ratio of approximately 1:7. Obviously, reactions (6) and (7) are not well separated. This is consistent with the observation that FeO is not a stable species.

Figure 21:
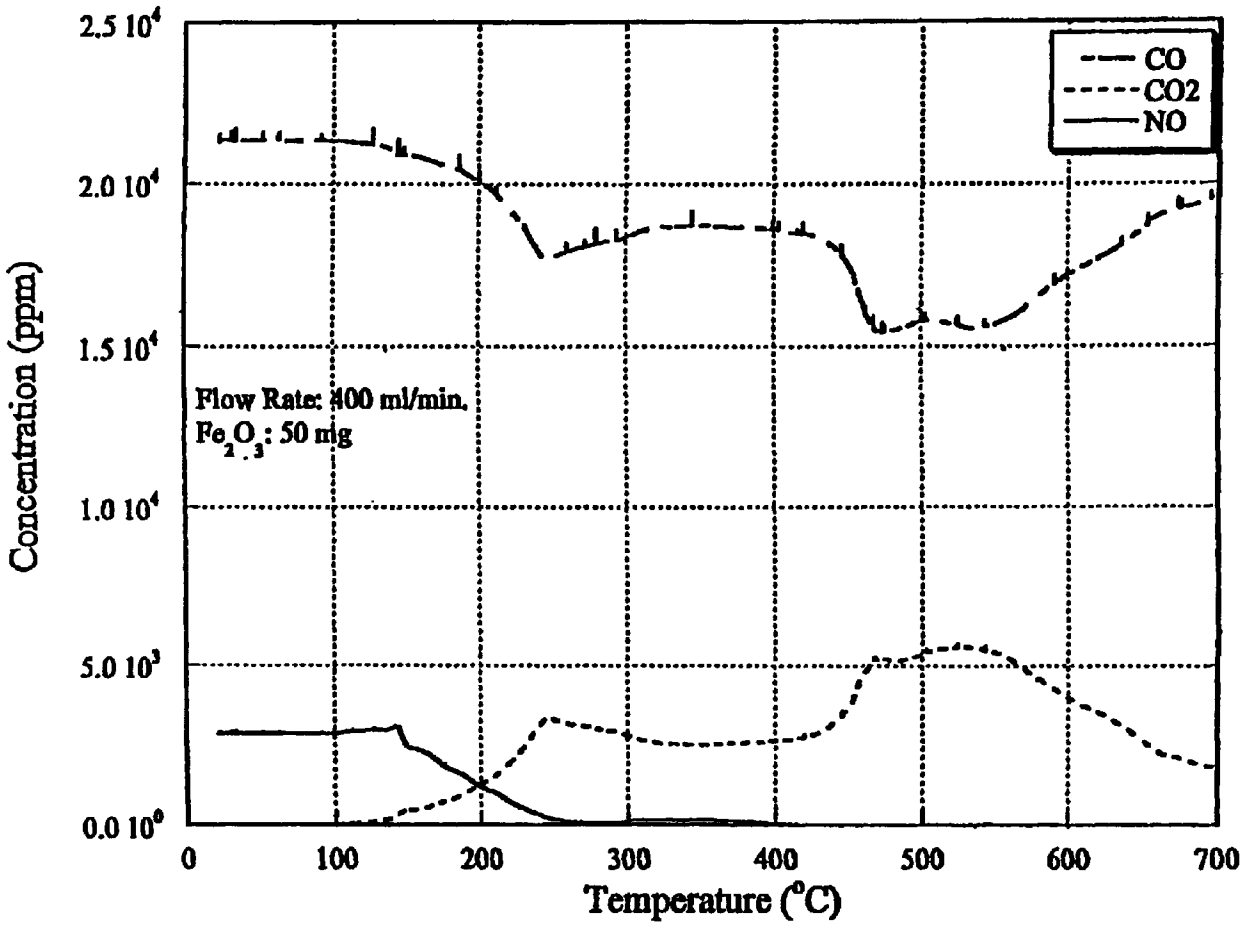
FIG. 21 depicts the conversion of carbon monoxide and nitric oxide to carbon dioxide and nitrogen.
Figure 22:
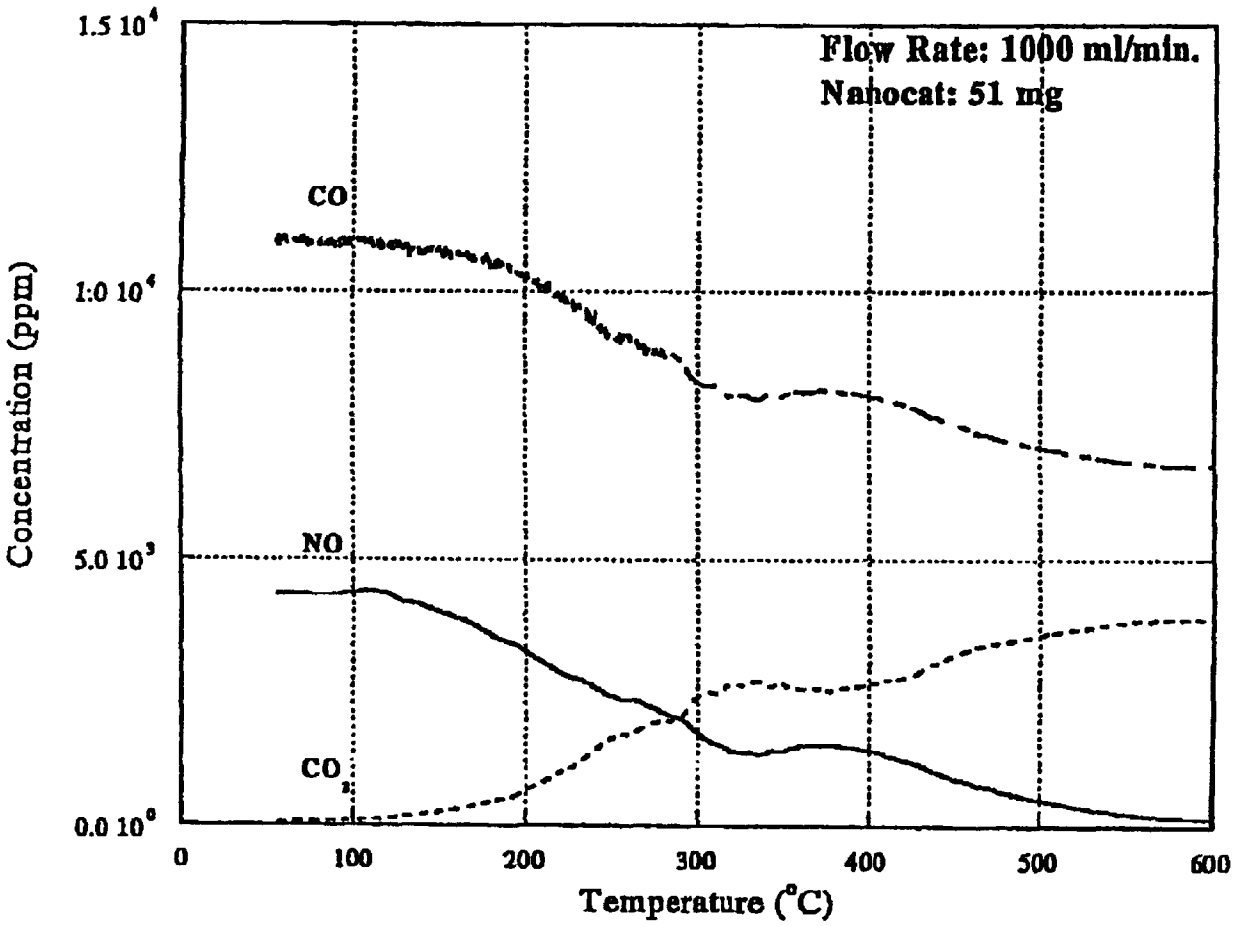
FIG. 22 depicts the concentrations of CO, NO, and $CO_2$ in the $2CO+2NO \approx 2CO_2+N_2$ reaction without oxygen.
Figure 23:
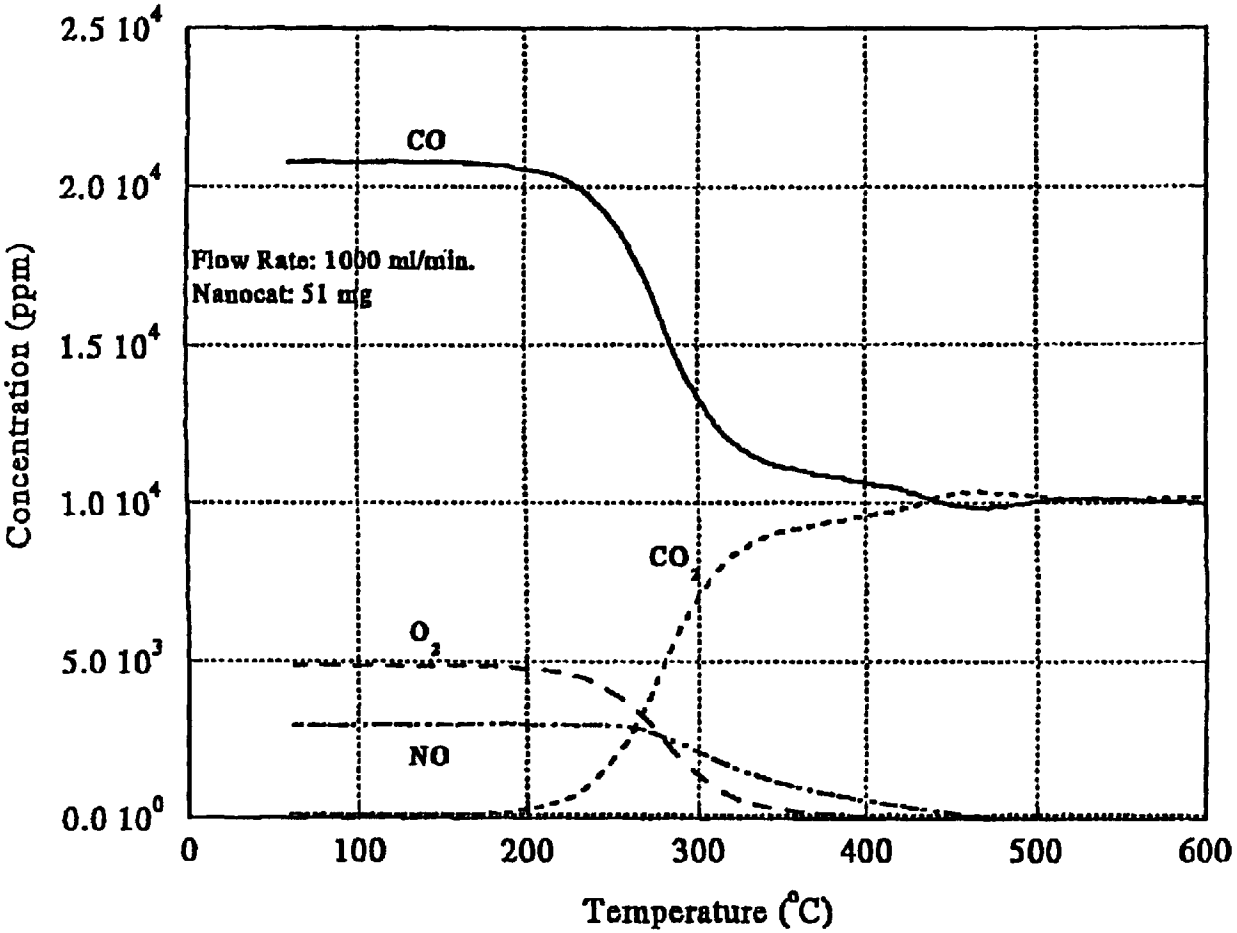
FIG. 23 depicts the concentrations of CO, NO, and $CO_2$ in the $2CO+2NO \approx 2CO_2+N_2$ reaction when carried out under a low concentration of oxygen.
Figure 24:
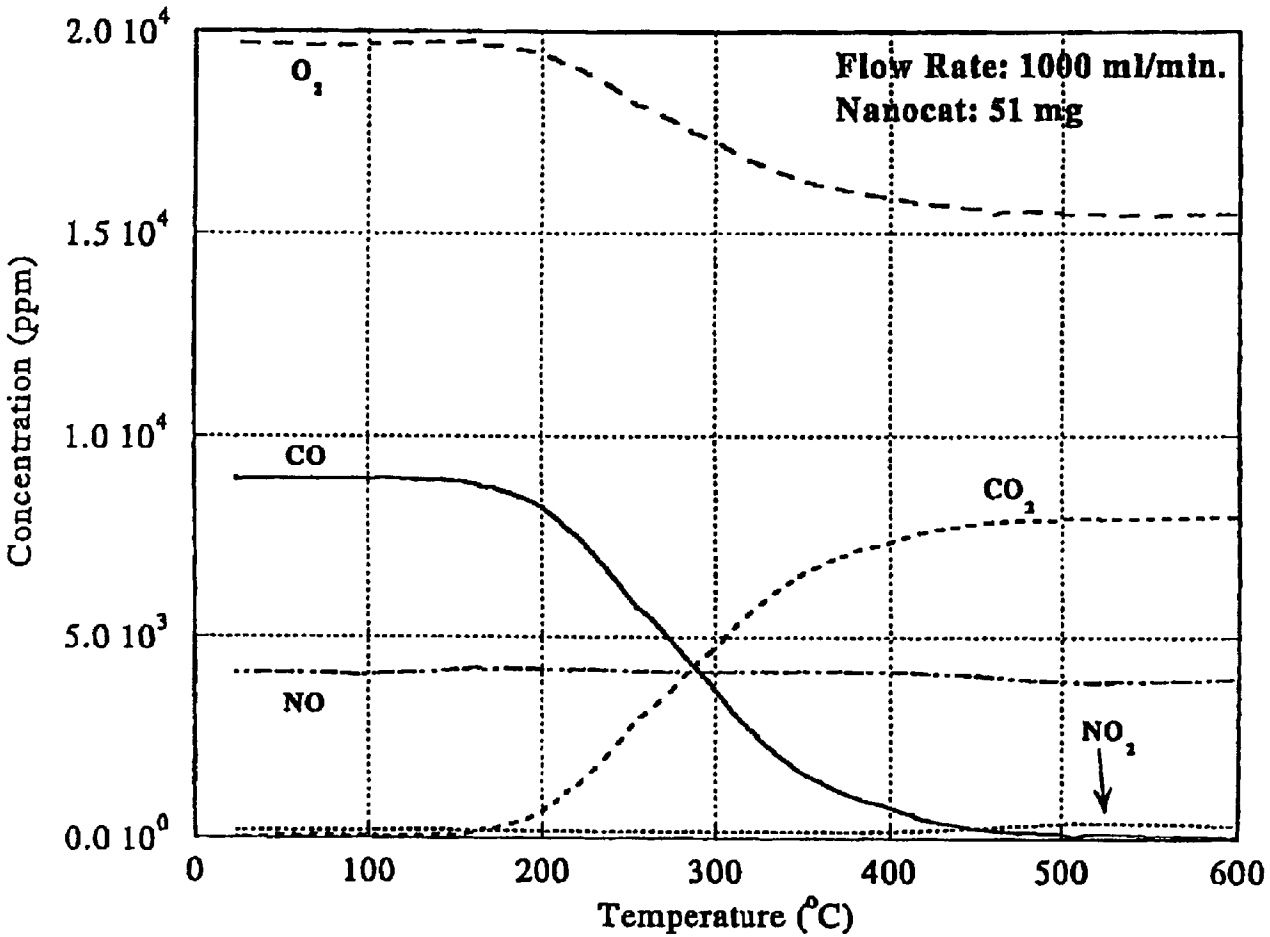
FIG. 24 depicts the concentrations of CO, NO, and $CO_2$ in the $2CO+2NO \approx 2CO_2+N_2$ reaction when carried out under a high concentration of oxygen.

FIG. 21 shows the temperature dependence of the reaction of carbon monoxide and nitric oxide to carbon dioxide and nitrogen reaction. FIGS. 22–24 show the effect of iron oxide nanoparticles on a gas stream containing CO, NO and He. FIG. 22 depicts the concentrations of CO, NO, and $CO_2$ in the $2CO+2NO \approx 2CO_2+N_2$ reaction without oxygen. FIG. 23 depicts the concentrations of these species when this reaction is carried out under a low concentration of oxygen and FIG. 24 depicts the concentrations when the reaction is carried out under a high concentration of oxygen. In the absence of any oxygen in the stream (as shown in FIG. 22), the reduction in NO concentration starts at about 120° C. By increasing the oxygen concentration (FIG. 23), the reduction in NO concentration shifts to about 260° C. At a higher level of oxygen (FIG. 24), the NO concentration remains unchanged.

Figure 25:
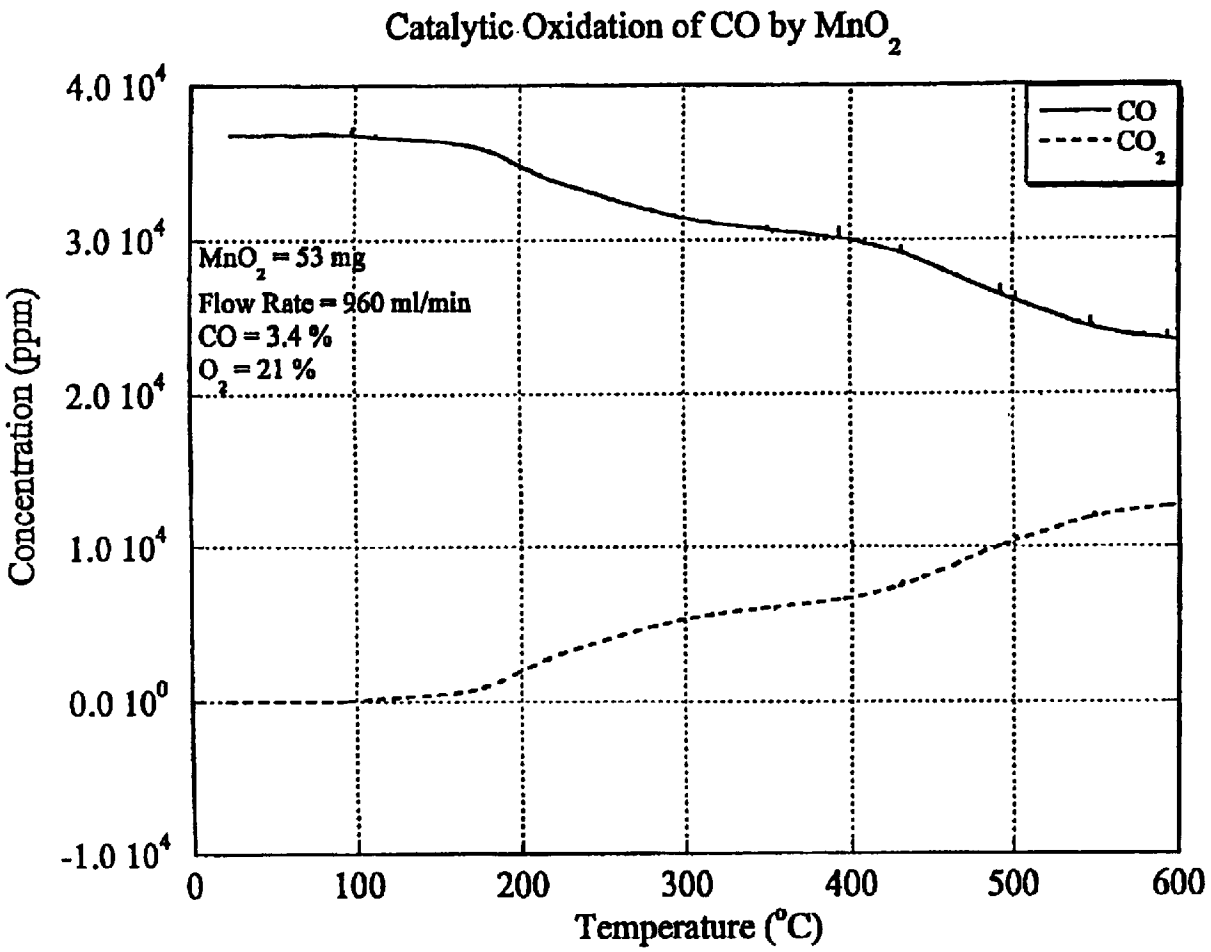
FIG. 25 depicts the catalytic oxidation of carbon monoxide by $MnO_2$ (ground powder, not in nanoparticle form).
Figure 26:
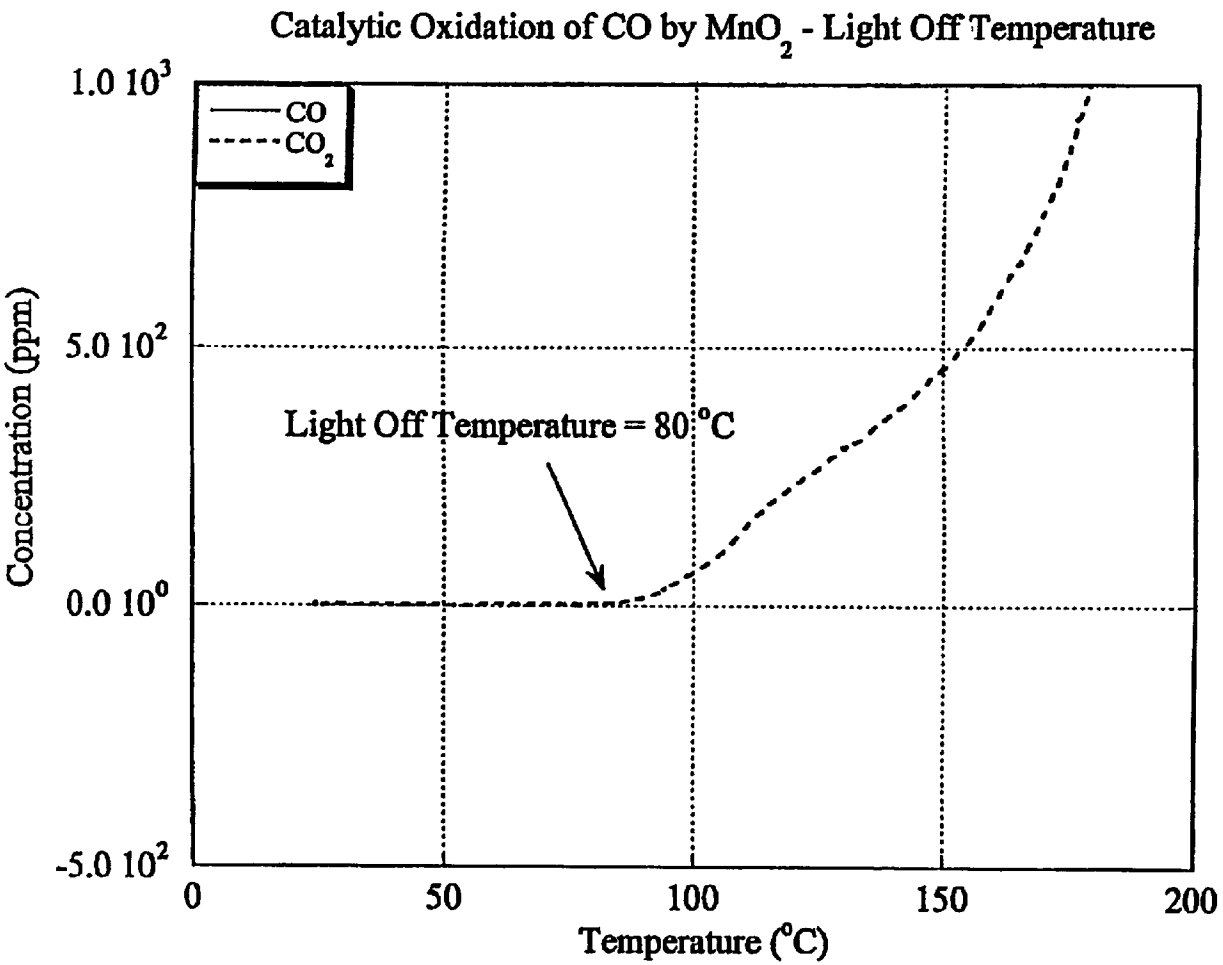
FIG. 26, which is an enlargement of FIG. 25 shows that the light-off temperature of $MnO_2$ for the catalytic oxidation of carbon monoxide is around 80° C.

Preferably, the manganese oxide has a lower light-off temperature than the additive, such that during smoking of the cigarette, the heat generated from the oxidation of carbon monoxide by manganese oxide activates the additive. For example, FIG. 25 depicts the catalytic oxidation of carbon monoxide by $MnO_2$. As can be seen from FIG. 25, $MnO_2$ ground powder is an effective catalyst for CO oxidation. FIG. 26, which is an enlargement of FIG. 25, shows that the light-off temperature of $MnO_2$ for the catalytic oxidation of carbon monoxide is around 80° C.

For example, since $MnO_2$ has a lower light-off temperature than that of $Fe_2O_3$, and the CO catalytic oxidation is highly exothermic (>100 Kcal/mol), when used together, the $MnO_2$ nanoparticles will be activated first at lower temperatures, and then the heat generated in the CO will heat up the $Fe_2O_3$ nanoparticles and activate them. In other words, the $MnO_2$ nanopaticles can be used as a light-off fuse to activate the $Fe_2O_3$ nanoparticle during smoking and can maximize the removal of carbon monoxide and/or nitric oxide.

The manganese oxide nanoparticle mixture, as described above, may be provided along the length of a tobacco rod by distributing the manganese oxide nanoparticle mixture on the tobacco or incorporating them into the cut filler tobacco using any suitable method. The nanoparticles may be provided in the form of a powder or in a solution in the form of a dispersion. In a preferred method, manganese oxide nanoparticle mixture in the form of a dry powder is dusted on the cut filler tobacco. The manganese oxide nanoparticle mixture may also be present in the form of a solution and sprayed on the cut filler tobacco. Alternatively, the tobacco may be coated with a solution containing the manganese oxide nanoparticle mixture. The manganese oxide nanoparticle mixture may also be added to the cut filler tobacco stock supplied to the cigarette making machine or added to a tobacco rod prior to wrapping cigarette paper around the cigarette rod.

The manganese oxide nanoparticle mixture will preferably be distributed throughout the tobacco rod portion of a cigarette and optionally the cigarette filter. By providing the manganese oxide nanoparticle mixture throughout the entire tobacco rod, it is possible to reduce the amount of carbon monoxide and/or nitric oxide throughout the cigarette, and particularly at the combustion region and in the pyrolysis zone. The amount of the manganese oxide nanoparticle mixture should be selected such that the amount of carbon monoxide and/or nitric oxide in mainstream smoke is reduced during smoking of a cigarette.

One embodiment of the invention relates to a cut filler composition comprising tobacco and the manganese oxide nanoparticle mixture, as described above, which is capable of acting as a catalyst for the conversion of carbon monoxide to carbon dioxide and/or a catalyst for the conversion of nitric oxide to nitrogen.

Any suitable tobacco mixture may be used for the cut filler. Examples of suitable types of tobacco materials include flue-cured, Burley, Md. or Oriental tobaccos, the rare or specialty tobaccos, and blends thereof. The tobacco material can be provided in the form of tobacco lamina; processed tobacco materials such as volume expanded or puffed tobacco, processed tobacco stems such as cut-rolled or cut-puffed stems, reconstituted tobacco materials; or blends thereof. The invention may also be practiced with tobacco substitutes.

In cigarette manufacture, the tobacco is normally employed in the form of cut filler, i.e. in the form of shreds or strands cut into widths ranging from about 1/10 inch to about 1/20 inch or even 1/40 inch. The lengths of the strands range from between about 0.25 inches to about 3.0 inches. The cigarettes may further comprise one or more flavorants or other additives (e.g. burn additives, combustion modifying agents, coloring agents, binders, etc.) known in the art.

In another embodiment of the invention, cigarettes are provided, which comprise a tobacco rod that comprises cut filler having manganese oxide and at least one additive capable of converting carbon monoxide to carbon dioxide and/or converting nitric oxide to nitrogen. The manganese oxide and the additive are both in the form of nanoparticles. In one embodiment, a cigarette according to the invention may comprise manganese oxide and the additive in a total amount from about 5 mg per cigarette to about 100 mg per cigarette, or in a total amount from about 40 mg per cigarette to about 50 mg per cigarette. Preferably, the manganese oxide and the additive are used in an amount effective to convert at least 50%, or more preferably at least 80% of the carbon monoxide to carbon dioxide and/or at least 50%, or more preferably at least 80% of the nitric oxide to nitrogen.

In another embodiment of the invention, methods for making cigarettes are provided, which comprise: (i) adding manganese oxide and at least one additive capable of converting carbon monoxide to carbon dioxide and/or converting nitric oxide to nitrogen to a cut filler, wherein the manganese oxide and the additive are both in the form of nanoparticles; (ii) providing the cut filler comprising the manganese oxide and additive to a cigarette making machine to form a tobacco rod; and (iii) placing a paper wrapper around the tobacco rod to form the cigarette. In an embodiment of the invention, the manganese oxide can be co-precipitated with the additive prior to step (i), or mechanically mixed with the additive prior to step (i).

Techniques for cigarette manufacture are known in the art. Any conventional or modified cigarette making technique may be used to incorporate the manganese oxide nanoparticle mixture. The resulting cigarettes can be manufactured to any known specifications using standard or modified cigarette making techniques and equipment. Typically, the cut filler composition of the invention is optionally combined with other cigarette additives, and provided to a cigarette making machine to produce a tobacco rod, which is then wrapped in cigarette paper, and optionally tipped with filters.

The cigarettes of the invention may range from about 50 mm to about 120 mm in length. Generally, a regular cigarette is about 70 mm long, a "King Size" is about 85 mm long, a "Super King Size" is about 100 mm long, and a "Long" is usually about 120 mm in length. The circumference is from about 15 mm to about 30 mm in circumference, and preferably around 25 mm. The packing density is typically between the range of about 100 mg/cm$^3$ to about 300 mg/cm$^3$, and preferably 150 mg/cm$^3$ to about 275 mg/cm$^3$.

Yet another embodiment of the invention relates to a method of smoking the cigarette described above, which involves lighting the cigarette to form smoke and drawing the smoke through the cigarette, wherein during the smoking of the cigarette, the manganese oxide nanoparticle mixture acts as a catalyst for the conversion of carbon monoxide to carbon dioxide and/or a catalyst for the conversion of nitric oxide to nitrogen.

"Smoking" of a cigarette means the heating or combustion of the cigarette to form smoke, which can be drawn through the cigarette. Generally, smoking of a cigarette involves lighting one end of the cigarette and drawing the cigarette smoke through the mouth end of the cigarette, while the tobacco contained therein undergoes a combustion reaction. However, the cigarette may also be smoked by other means. For example, the cigarette may be smoked by heating the cigarette and/or heating using electrical heater means, as described in commonly-assigned U.S. Pat. Nos. 6,053,176; 5,934,289; 5,591,368 or 5,322,075, for example.

While the invention has been described with reference to preferred embodiments, it is to be understood that variations and modifications may be resorted to as will be apparent to those skilled in the art. Such variations and modifications are to be considered within the purview and scope of the invention as defined by the claims appended hereto.

All of the above-mentioned references are herein incorporated by reference in their entirety to the same extent as if each individual reference was specifically and individually indicated to be incorporated herein by reference in its entirety.

What is claimed is:

1. A cut filler composition comprising tobacco, and a coprecipitate of manganese oxide and at least one additive capable of converting carbon monoxide to carbon dioxide and/or converting nitric oxide to nitrogen, wherein the manganese oxide and the additive are both in the form of nanoparticles.

2. The cut filler composition of claim 1, wherein the additive is capable of converting carbon monoxide to carbon dioxide and converting nitric oxide to nitrogen.

3. The cut filler composition of claim 1, wherein the additive is selected from the group consisting of metal oxides, doped metal oxides, and mixtures thereof.

4. The cut filler composition of claim 3, wherein the additive is selected from the group consisting of $Fe_2O_3$, CuO, $TiO_2$, $CeO_2$, $Ce_2O_3$, $Al_2O_3$, $Y_2O_3$ doped with zirconium, $Mn_2O_3$ doped with palladium, and mixtures thereof.

5. The cut filler composition of claim 3, wherein the additive comprises $Fe_2O_3$.

6. The cut filler composition of claim 1, wherein manganese oxide has a lower light-off temperature than the additive.

7. The cut filler composition of claim 1, wherein the manganese oxide and the additive both have an average particle size less than about 100 nm.

8. The cut filler composition of claim 7, wherein the manganese oxide and the additive both have an average particle size less than about 5 nm.

9. The cut filler composition of claim 1, wherein the manganese oxide and the additive both have an average particle size less than about 50 nm.

10. The cut filler composition of claim 1, wherein the manganese oxide and the additive both have a surface area from about 20 $m^2/g$ to about 400 $m^2/g$.

11. The cut filler composition of claim 10, wherein the manganese oxide and the additive both have a surface area from about 200 $m^2/g$ to about 300 $m^2/g$.

12. The cut filler composition of claim 1, wherein a ratio of the manganese oxide to the additive(s) is from about 1:100 to about 100:1 of the manganese oxide and the additive(s) respectively.

13. The cut filler composition of claim 1, wherein a ratio of the manganese oxide to the additive(s) is from about 20:80 to about 80:20 of the manganese oxide and the additive(s) respectively.

14. The cut filler composition of claim 1, wherein a ratio of the manganese oxide to the additive(s) is from about 30:70 to about 70:30 of the manganese oxide and the additive(s) respectively.

15. The cut filler composition of claim 1, wherein a ratio of the manganese oxide to the additive(s) is from about 40:60 to about 60:40 of the manganese oxide and the additive(s) respectively.

16. The cut filler composition of claim 1, wherein a ratio of the manganese oxide to the additive(s) is from about 50:50 to about 50:50 of the manganese oxide and the additive(s) respectively.

17. A cigarette comprising a tobacco rod, wherein the tobacco rod comprises cut filler containing a coprecipitate of manganese oxide and at least one additive capable of converting carbon monoxide to carbon dioxide and/or converting nitric oxide to nitrogen, wherein the manganese oxide and the additive are both in the form of nanoparticles.

18. The cigarette of claim 17, wherein the additive is capable of converting carbon monoxide to carbon dioxide and converting nitric oxide to nitrogen.

19. The cigarette of claim 17, wherein the additive is selected from the group consisting of metal oxides, doped metal oxides, and mixtures thereof.

20. The cigarette of claim 17, wherein the additive is selected from the group consisting of $Fe_2O_3$, CuO, $TiO_2$, $CeO_2$, $Ce_2O_3$, $Al_2O_3$, $Y_2O_3$ doped with zirconium, $Mn_2O_3$ doped with palladium, and mixtures thereof.

21. The cigarette of claim 17, wherein the additive comprises $Fe_2O_3$.

22. The cigarette of claim 17, wherein the manganese oxide has a lower light-off temperature than the additive, and wherein the heat generated during smoking of the cigarette from the oxidation of carbon monoxide by manganese oxide is capable of activating the additive.

23. The cigarette of claim 17, wherein the manganese oxide and the additive are present in an amount effective to convert at least 50% of the carbon monoxide generated during smoking to carbon dioxide.

24. The cigarette of claim 23, wherein the manganese oxide and the additive are present in an amount effective to convert at least 80% of the carbon monoxide generated during smoking to carbon dioxide.

25. The cigarette of claim 17, wherein the manganese oxide and the additive are present in an amount effective to convert at least 50% of the nitric oxide generated during smoking to nitrogen.

26. The cigarette of claim 25, wherein the manganese oxide and the additive are present in an amount effective to convert at least 80% of the nitric oxide generated during smoking to nitrogen.

27. The cigarette of claim 17, wherein the manganese oxide and the additive both have an average particle size less than about 100 nm.

28. The cigarette of claim 17, wherein the manganese oxide and the additive both have an average particle size less than about 50 nm.

29. The cigarette of claim 28, wherein the manganese oxide and the additive both have an average particle size less than about 5 nm.

30. The cigarette of claim 17, wherein the manganese oxide and the additive both have a surface area from about 20 $m^2/g$ to about 400 $m^2/g$.

31. The cigarette of claim 30, wherein the manganese oxide and the additive both have a surface area from about 200 $m^2/g$ to about 300 $m^2/g$.

32. The cigarette of claim 17, wherein the cigarette comprises manganese oxide and the additive in a total amount from about 5 mg per cigarette to about 100 mg per cigarette.

33. The cigarette of claim 32, wherein the cigarette comprises manganese oxide and the additive in a total amount from about 40 mg per cigarette to about 50 mg per cigarette.

34. The cigarette of claim 17, wherein a ratio of the manganese oxide to the additive(s) is from about 1:100 to about 100:1 of the manganese oxide and the additive(s) respectively.

35. The cigarette of claim 17, wherein a ratio of the manganese oxide to the additive(s) is from about 20:80 to about 80:20 of the manganese oxide and the additive(s) respectively.

36. The cigarette of claim 17, a ratio of the manganese oxide to the additive(s) is from about 30:70 to about 70:30 of the manganese oxide and the additive(s) respectively.

37. The cigarette of claim 17, wherein a ratio of the manganese oxide to the additive(s) is from about 40:60 to about 60:40 of the manganese oxide and the additive(s) respectively.

38. The cigarette of claim 17, wherein a ratio of the manganese oxide to the additive(s) is from about 50:50 to about 50:50 of the manganese oxide and the additive(s) respectively.

39. A method of making a cigarette, comprising (i) adding a coprecipitate of manganese oxide and at least one additive capable of converting carbon monoxide to carbon dioxide and/or converting nitric oxide to nitrogen to a cut filler, wherein the manganese oxide and the additive are both in the form of nanoparticles;

(ii) providing the cut filler comprising the manganese oxide and additive to a cigarette making machine to form a tobacco rod; and (iii) placing a paper wrapper around the tobacco rod to form the cigarette.

40. The method of claim 39, wherein the additive comprises $Fe_2O_3$.

41. The method of claim 39, wherein the manganese oxide and the additive are added in an amount effective to convert at least 50% of the carbon monoxide generated during smoking to carbon dioxide.

42. The method of claim 41, wherein the manganese oxide and the additive are added in an amount effective to convert at least 80% of the carbon monoxide generated during smoking to carbon dioxide.

43. The method of claim 39, wherein the manganese oxide and the additive are added in an amount effective to convert at least 50% of the nitric oxide generated during smoking to nitrogen.

44. The method of claim 43, wherein the manganese oxide and the additive are added in an amount effective to convert at least 80% of the nitric oxide generated during smoking to nitrogen.

45. The method of claim 39, wherein the manganese oxide and the additive are added in a total amount from about 5 mg per cigarette to about 100 mg per cigarette.

46. The method of claim 45, wherein the manganese oxide and the additive are added in a total amount from about 40 mg per cigarette to about 50 mg per cigarette.

47. The method of claim 39, wherein a ratio of the manganese oxide to the additive(s) is from about 1:100 to about 100:1 of the manganese oxide and the additive(s) respectively.

48. The method of claim 39, wherein a ratio of the manganese oxide to the additive(s) is from about 20:80 to about 80:20 of the manganese oxide and the additive(s) respectively.

49. The method of claim 39, wherein a ratio of the manganese oxide to the additive(s) is from about 30:70 to about 70:30 of the manganese oxide and the additive(s) respectively.

50. The method of claim 39, wherein a ratio of the manganese oxide to the additive(s) is from about 40:60 to about 60:40 of the manganese oxide and the additive(s) respectively.

51. The method of claim 39, wherein a ratio of the manganese oxide to the additive(s) is from about 50:50 to about 50:50 of the manganese oxide and the additive(s) respectively.

52. A method of smoking the cigarette of claim 17, comprising lighting the cigarette to form smoke and drawing the smoke through the cigarette, wherein during the smoking of the cigarette, the manganese oxide and/or the additive convert carbon monoxide to carbon dioxide and/or convert nitric oxide to nitrogen.

53. The method of claim 52, wherein the manganese oxide has a lower light-off temperature than the additive, and wherein during smoking of the cigarette, the heat generated from the oxidation of carbon monoxide by manganese oxide activates the additive.

* * * * *